US005952138A

United States Patent [19]

Kuwashima et al.

[11] Patent Number: 5,952,138

[45] Date of Patent: Sep. 14, 1999

[54] MAGNETIC DEVELOPER AND RECOGNITION METHOD OF MAGNETIC-INK CHARACTER

[75] Inventors: Tetsuhito Kuwashima, Toride; Satoshi Matsunaga, Tokyo; Yukari Ishibashi, Yokohama, all of Japan

[73] Assignee: Canon Kabushiki Kaisha, Tokyo, Japan

[21] Appl. No.: 08/414,053

[22] Filed: Mar. 30, 1995

Related U.S. Application Data

[62] Division of application No. 08/066,220, May 25, 1993, abandoned.

[30] Foreign Application Priority Data

May 25, 1992 [JP] Japan ..... 4-156222

[51] Int. Cl.[6] ..... G03G 19/00

[52] U.S. Cl. ..... 430/39; 430/106.6; 430/109

[58] Field of Search ..... 430/39, 106.6, 430/109

[56] References Cited

U.S. PATENT DOCUMENTS

| | | | |
|---|---|---|---|
| 4,804,610 | 2/1989 | Mori et al. | 430/137 |
| 4,946,755 | 8/1990 | Inoue | 430/106.6 |
| 4,952,476 | 8/1990 | Sakashita et al. | 430/106.6 |
| 5,135,833 | 8/1992 | Matsunaga et al. | 430/110 |
| 5,168,311 | 12/1992 | Hino | 355/251 |

FOREIGN PATENT DOCUMENTS

| | | | |
|---|---|---|---|
| 417016 | 3/1991 | European Pat. Off. . | |
| 468525 | 1/1992 | European Pat. Off. . | |
| 531990 | 3/1993 | European Pat. Off. . | |
| 59-7379 | 1/1984 | Japan | G03G 15/00 |
| 59-20484 | 2/1984 | Japan | C25C 3/08 |
| 63-108354 | 5/1988 | Japan | G03G 9/08 |

OTHER PUBLICATIONS

Patent Abstracts of Japan, vol. 5, No. 88 (P–65) Jun. 1981 of JPA 56–033655.

*Primary Examiner*—Maria Nuzzollo
*Assistant Examiner*—Laura Weiner
*Attorney, Agent, or Firm*—Fitzpatrick, Cella, Harper & Scinto

[57] ABSTRACT

The invention relates to a magnetic developer comprising a magnetic toner containing at least a binder resin, a magnetic material and a hydrocarbon wax,wherein said magnetic toner has such properties that:

a DSC curve of the toner measured by the use of a differential scanning calorimeter is characterized in that with an endothermic peak in raising temperature, its onset temperature is 105° C. or below and its peak temperature is in the range of from 100° C. to 120° C., and that with an exothermic peak in dropping temperature its peak temperature is in the range of from 62° C. to 75° C. and its peak intensity ratio is $5\times10^{-3}$ or more; and said magnetic material has such properties that:

a residual magnetization 6r is in the range of from 12 emu/g to 30 emu/g and a coercive force Hc is in the range of from 130 oersteds to 300 oersteds in a magnetic field of 10,000 oersteds.

30 Claims, 14 Drawing Sheets

MAGNETIC DEVELOPER AND RECOGNITION METHOD OF MAGNETIC-INK CHARACTER

This application is a division, of application Ser. No. 08/066,220 filed May 25, 1993, which is now abandoned.

BACKGROUND OF THE INVENTION

1. Field of the Invention

The present invention relates to a magnetic developer to be used in a developing assembly to develop a latent image formed on an image bearing member such as an electrophotographic photosensitive member or an electrostatic recording dielectric. It also relates to a method of magnetic-ink character recognition to read and recognize the magnetism of magnetic ink characters printed with the magnetic developer. The present invention also relates to a magnetic developer suited for printing characters having magnetism, used in a magnetic-ink character recognition system.

2. Related Background Art

The magnetic developer of the present invention can be preferably used in an electrophotographic image forming process as a magnetic developer for converting a digital latent image into a visible image by a reversal development system, in which the latent image is expressed by unit picture elements and the unit picture elements are represented by on-off binary or finite gradation.

Conventionally, a developing system using a magnetic toner serving as a one-component developer to convert a latent image formed on a photosensitive drum serving as an electrostatic latent image bearing member into visible images is as follows. Toner particles are imparted with electric charges with a polarity opposite to that of the development standard potential and the electrostatic image formed on the photosensitive drum by friction between magnetic toner particles themselves and between a sleeve serving as a developer carrying member and magnetic toner particles, and the magnetic toner particles thinly spread on the sleeve are transported to the developing zone between the photosensitive drum and the sleeve, and in the developing zone the magnetic toner is propelled to the latent image by the action of a magnetic field formed by a magnet fixed inside the sleeve, thus converting an electrostatic latent image on the photosensitive drum into a visible image.

In recent years, with the popularization of image forming apparatus such as electrophotographic copying machines, their use has spread over various fields. With such a background, a printer for the magnetic-ink character recognition (hereinafter abbreviated "MICR") system has been proposed as an application of electrophotographic printers.

The MICR system is a system mainly devised to efficiently assort checks and bills using a magnetic character reader in clearing houses, on which information data such as bank names, amounts and account numbers have been printed with a magnetic ink. Offset printing using a magnetic ink has been hitherto prevailing. However, as commercial transactions of personal checks, bills and so forth have become active, there is an increasing demand for small-sized printers of MICR characters (hereinafter simply called "MICR encoder(s)".

As conventional small-sized MICR encoders, impact printers applying a thermal transfer system are prevalent. Most of such printers, however, are mono-functional machines printing only MICR characters, and can not be utilized in the preparation of conventional documents. Hence, further improvement has been pursued.

It is sought to provide an electrophotographic printer that can print conventional documents and/or graphics and as well as MICR characters with a good MICR recognition rate. When the electrophotographic printer is applied to MICR encoders using a conventional magnetic developer, the accuracy (recognition rate) in the magnetic character reading by an MICR reader-sorter is very poor, compared with offset printing or printing with the impact printer. Thus, its use is not practical.

Securities on which the MICR characters have been printed are usually passed through the MICR reader-sorter about ten times on average. Every time they pass through the machine for magnetic character reading, they rub against the magnetic head at, a high speed. Hence, the magnetic developer used for printing the MICR characters is required to inhibit smearing or falling-off of characters as a result of rubbing.

For the MICR characters, there is a standard called E-13B, prescribed in ANS (American National Standard) x9.27-198x or JIS C6251-1980. The E-13B standard is constituted of numbers of 0 to 9 and four kinds of symbols. Bank codes, branch office codes, account numbers, amounts and so forth are printed on securities in combinations of such numbers and symbols.

In order to improve the recognition rate of the MICR reader-sorters, the shape and size of printed MICR characters are required to be reproduced in a high precision, and characters must be finely and faithfully reproduced without crushed or broken line images.

In order to achieve a high recognition rate in MICR character printing using the electrophotographic printer, it is necessary to use a magnetic developer containing a specific magnetic material having magnetic properties different from magnetic materials used in conventional magnetic developers.

That is, it is necessary to use a magnetic material showing a relatively large residual magnetization $\sigma r$.

The magnetic developer is also required to Show as good triboelectric chargeability as the conventional magnetic developers of conventional electrophotographic printers, as well as uniform coating ability on the developer-carrying member (hereinafter "sleeve") of the developing assembly. To meet such requirements, the permeability of a magnetic material contained in the magnetic developer is also important.

Japanese Laid-Open Patent Application No. 59-7379 discloses a magnetic toner containing a cobalt-substituted tri-iron tetraoxide powder with a length/breadth ratio (major axis/minor axis ratio) of 1 to 5 and having a residual magnetization of 10 to 20 emu/g and a coercive force of 150 to 450 oersteds. It, however, is difficult for this toner to form a uniform toner layer on the sleeve, and the toner has a poor triboelectric chargeability and may give a low image density and a poor sharpness.

Japanese Laid-Open Patent Application No. 63-108354 discloses an insulating magnetic capsule toner containing a spherical magnetic powder having a length/breadth ratio of 1 to 1.5 and a permeability of 3.80 to 6.00. Japanese Laid-Open Patent Application No. 59-20484 also discloses a magnetic toner containing a ferromagnetic powder having a maximum permeability of 3.95 to 5.50. These toners can achieve a high image density and are preferable, but further improvement is required to meet higher requirements for resolution and adaptability to reversal development systems.

SUMMARY OF THE INVENTION

An object of the present invention is to provide a magnetic developer that has solved the above problems, and a method of magnetic-ink character recognition making use of such a magnetic developer.

More specifically, an object of the present invention is to provide a magnetic developer resistant to smearing or falling-off even when the MICR printed paper is repeatedly passed through an MICR reader-sorter, and a recognition method of magnetic-ink character printed with such a magnetic developer.

Another object of the present invention is to provide a magnetic developer that does not soil or contaminate the magnetic head of an MICR reader-sorter even when the MICR-printed paper is repeatedly passed through the MICR reader-sorter, and a recognition method of magnetic-ink character printed with such a magnetic developer.

Still another object of the present invention is to provide a magnetic developer that can form a toner image of superior resolution, gradation and fine-line reproduction even in an image forming apparatus in which a latent image is formed according to digital image signals and developed by a reversal development system, and a recognition method of magnetic-ink character printed with such a magnetic developer.

A further object of the present invention is to provide a magnetic developer which brings about a superior recognition rate when used in MICR printing utilizing an electrophotographic printer, and a recognition method of magnetic-ink character recognition printed with such a magnetic developer.

A still further object of the present invention is to provide a magnetic developer that may cause no decrease in the recognition rate even when the MICR-printed paper is repeatedly passed through an MICR reader-sorter, and a recognition method of magnetic-ink character printed with such a magnetic developer.

A still further object of the present invention is to provide a magnetic developer that can achieve superior fine-line reproduction and resolution, and can faithfully reproduce characters according to their standard when MICR characters are printed, and a recognition method of magnetic-ink character printed with such a magnetic developer.

The present invention provides a magnetic developer comprising a magnetic toner containing at least a binder resin, a magnetic material and a hydrocarbon wax, wherein;

said magnetic toner satisfies the properties that, in the DSC curve measured using a differential scanning calorimeter, an onset temperature of an endothermic peak is 105° C. or below and an endothermic peak temperature is within the range of from 100° C. to 200° C. during temperature rise, and an exothermic peak temperature is within the range of from 62° C. to 75° C. and an exothermic peak intensity ratio is $5\times10^{-3}$ or more during temperature lowering; and said magnetic material has a residual magnetization σr in the range of from 12 emu/g to 30 emu/g and a coercive force Hc in the range of from 130 oersteds to 300 oersteds in the magnetic field of 10,000 oersteds.

The present invention also provides a magnetic developer comprising a magnetic toner containing at least a binder resin, a magnetic material and a hydrocarbon wax, wherein;

said hydrocarbon wax satisfies the properties that, in the DSC curve measured using a differential scanning calorimeter, an onset temperature of an endothermic peak observed during temperature rise is within the range of from 50° C. to 90° C, at least one endothermic peak P1 is present in a temperature range of from 90° C. to 120° C. and the highest exothermic peak observed during temperature lowering is present in the range of ±9° C. of a peak temperature of the endothermic peak P1; and said magnetic material has a residual magnetization σr in the range of from 12 emu/g to 30 emu/g and a coercive force Hc in the range of from 130 oersteds to 300 oersteds in the magnetic field of 10,000 oersteds.

The present invention still also provides a method of magnetic-ink character recognition, comprising;

printing a magnetic-ink character on a recording medium using a magnetic developer;

imparting magnetism to the printed magnetic-ink character, and;

reading and recognizing the magnetism of the magnetic-ink character to which magnetism has been imparted;

said magnetic developer comprising a magnetic toner containing at least a binder resin, a magnetic material and a hydrocarbon wax; wherein;

said magnetic toner satisfies the properties that, in the DSC curve measured using a differential scanning calorimeter, an onset temperature of an endothermic peak observed during temperature rise is 105° C. or below and an endothermic peak temperature is within the range of from 100° C. to 200° C., and an exothermic peak temperature of an exothermic peak observed during temperature lowering is within the range of from 62° C. to 75° C. and an exothermic peak intensity ratio is $5\times10^{-3}$ or more; and said magnetic material has a residual magnetization σr in the range of from 12 emu/g to 30 emu/g in a magnetic field of 10,000 oersteds and a corecive force Hc in the range of from 130 oersteds to 300 oersteds in a magnetic field of 10,000 oersteds.

The present invention further provides a method of magnetic-ink character recognition, comprising;

printing a magnetic-ink character on a recording medium by the use of a magnetic developer;

imparting magnetism to the printed magnetic-ink character, and;

reading and recognizing the magnetism of the magnetic-ink character to which magnetism has been imparted;

said magnetic developer comprising a magnetic toner containing at least a binder resin, a magnetic material and a hydrocarbon wax; wherein;

said hydrocarbon wax satisfies the properties that, in the DSC curve measured using a differential scanning calorimeter, an onset temperature of an endothermic peak is within the range of from 50° C. to 90° C., at least one endothermic peak P1 is present in a temperature range of from 90° C. to 120° C. and the largest exothermic peak observed during temperature lowering is present within ±9° C. of the peak temperature of the endothermic peak P1; and said magnetic material has a residual magnetization σr in the range of from 12 emu/g to 30 emu/g and a coercive force Hc in the range of from 130 oersteds to 300 oersteds in the magnetic field of 10,000 oersteds.

DESCRIPTION OF THE PREFERRED EMBODIMENTS

Figure 1:
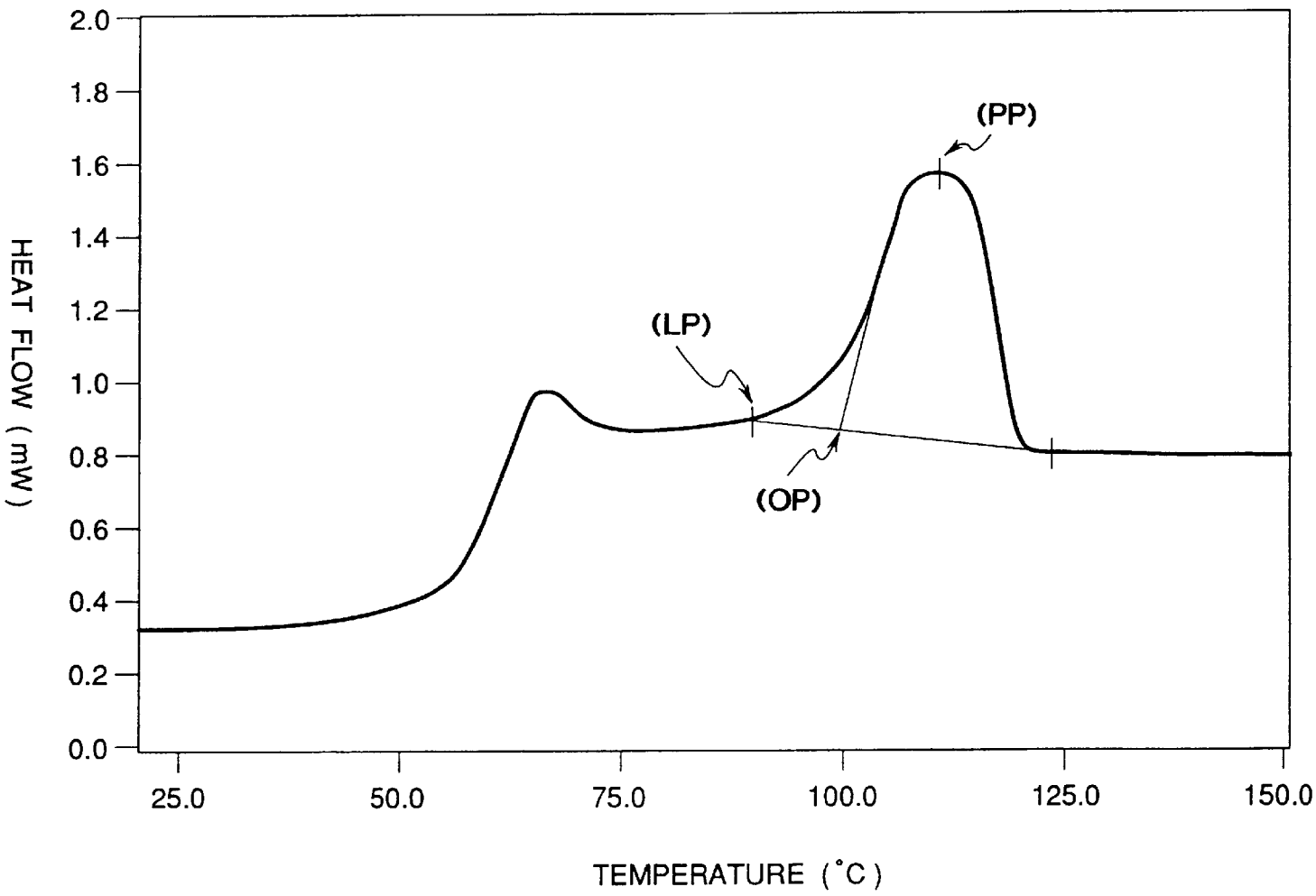
FIG. 1 illustrates the DSC curve during temperature rise, of magnetic developer 1 according to the present invention.

The present invention is concerned with a magnetic developer comprising a magnetic toner containing at least a binder resin, a magnetic material and a hydrocarbon wax.

In the present invention, the characteristic feature is that the magnetic toner satisfies the following properties, that is, in the DSC curve measured using a differential scanning calorimeter, the onset temperature of an endothermic peak is 105° C. or below and an endothermic peak temperature is within the range of from 100° C. to 200° C. during temperature rise, and an exothermic peak temperature is within the range of from 62° C. to 75° C. and the exothermic peak intensity ratio is $5\times10^{-3}$ or more during temperature lowering. Its use in combination with a magnetic material having specific magnetic properties as described later can achieve the objects previously stated.

Thermal behavior of the toner can be shown by measuring the toner using a differential scanning calorimeter and analyzing the data. More specifically, heat flow (heat absorption and liberation) of the toner and changes in condition of the toner can be known from the data. For example, it is possible to know the probability of offset phenomenon, the influence of the heat on the toner during storage or actual use, e.g., blocking resistance, and the influence of the temperature rise on developability.

During temperature rise, changes of the toner conditions on heat application can be observed, and endothermic peaks are ascribed to the transition, melting and dissolution of the wax components. The present invention is characterized in that the onset temperature of an endothermic peak during temperature rise is 105° C. or below, and preferably in the range of from 90 to 102° C. This brings about a superior low-temperature fixing performance. If the onset temperature is higher than 105° C., the temperature at which the plastic change immediatedly occurs becomes higher causing deterioration in low-temperature offset resistance and fixing performance.

The present invention is also characterized in that the endothermic peak temperature during temperature rise is within the range of from 100 to 120° C., and preferably from 102 to 115° C. When the wax in the toner melts within this temperature range, the resulting release effect prevents the smearing of MICR characters even when the MICR-printed paper is repeatedly passed through an MICR reader-sorter and also reduces the contamination of the magnetic head of the MICR reader-sorter.

If this endothermic peak temperature is lower than 100° C., a plasticizing effect due to the wax melting is exerted at a low temperature resulting in considerable decrease in mechanical strength of the binder resin. In such a case, when the MICR printed paper is passed through an MICR reader-sorter, the release effect is exerted with the decrease in mechanical strength of the binder resin causing smearing of MICR characters when they rub against the magnetic head of the MICR reader-sorter as well as the contamination of the magnetic head.

Other endothermic peaks may be present in a temperature region higher than 120° C. In that case, however, a peak should be present in the region not higher than 120° C. Otherwise, the wax may have an excessively high melting temperature, which means increased releasability from the paper in MICR printing, causing falling-off of MICR characters when rubbed against the magnetic head when the MICR printed paper is passed through an MICR reader-sorter, undesirably resulting in reading error.

During temperature lowering, condition of toner at room temperature and changes in condition thereof on cooling can be seen. The observed exothermic peaks are ascribable to transition, solidification and crystallization of the wax components. The present invention is characterized in that the exothermic peak observed during temperature lowering is within the range of from 62 to 75° C., and preferably from 65 to 72° C. This brings about a good MICR performance. If this exothermic peak temperature is higher than 75° C., the melting temperature of the wax is excessively high, tending to cause falling-off of MICR characters when rubbed against the magnetic head while the MICR printed paper is passed through an MICR reader-sorter. If it is lower than 62° C., the plasticizing effect on the binder resin may last to a low temperature, undesirably causing smearing of MICR characters when the MICR-printed paper is passed through an MICR reader-sorter as well as the contamination of the magnetic head of the MICR reader-sorter.

The present invention is characterized in that the intensity ratio of the exothermic peak observed during temperature lowering is $5\times10^{-3}$ or more, preferably $10\times10^{-3}$ or more, and more preferably $15\times10^{-3}$ or more. The larger the exothermic peak intensity ratio becomes, the higher the density, crystallinity and hardness of the wax component become, so that a suitable release effect can be obtained to prevent the smearing of MICR characters as well as the contamination of the magnetic head of the MICR reader-sorter when the MICR printed paper is passed through an MICR reader-sorter. If this exothermic peak intensity ratio is less than $5\times10^{-3}$ the toner is undesirably liable to cause smearing of MICR characters when rubbed against the magnetic head of an MICR reader-sorter as well as the contamination of the magnetic head of the MICR reader-sorter. When, however, the conditions are fulfilled, peaks may be present in other region not lower than 75° C.

In DSC measurement in the present invention, the heat flow of the toner is measured and its behavior is observed. Hence, from the principle of measurement, the measurement must be made using a differential scanning calorimeter of a high-precision internal heating input-compensating type. For example, DSC-7, manufactured by Parkin Elmer Co., can be used as a measuring device for such purpose.

The measurement is made according to ASTM D3418-82. The DSC curve used in the present invention is the DSC curve measured when temperature is raised once to take a previous history and thereafter temperature is lowered and raised again at a temperature rate of 10° C./min. Each temperature is defined as follows:

Endothermic Peak (plus direction is regarded as being endothermic)

Rising temperature (LP) of a peak is defined as a temperature at which the peak curve clearly separates from the base line. More specifically, a temperature at which the differential of the peak curve begins to increase, or a temperature at which the differential of the peak curve turns from negative to positive. (FIGS. 1, 3 to 6 show some examples.)

Onset temperature (OP) of a peak is defined as a temperature at which a tangent line drawn through a point at which the differential value of the curve is extreme, intersects the base line. (FIG. 1 shows an example).

Peak temperature (PP) is a peak top temperature of the highest peak in the region of 120° C. or below.

Exothermic Peak (minus direction is regarded as being endothermic).

Exothermic peak temperature is a peak top temperature.

Exothermic peak intensity ratio is defined as $\Delta H/\Delta T$ wherein $\Delta T$ represents a temperature difference between the intersections of the base line and two tangent lines of the curve, each tangent line drawn through the point at which the differential of the curve is extreme in front or in the rear of the peak top respectively; and $\Delta H$ represents a height per unit weight from the base line to the peak top (mW/mg, a value obtained by dividing the measured peak height, by the weight of the measured sample). (FIGS. 2 and 7 to 10 show specific examples of $\Delta H$ and $\Delta T$.) Namely, when this value is large, it means that the peak is sharp.

The hydrocarbon wax used in the present invention is a hydrocarbon wax prepared by extraction fractionation of a specific component from a material such as (i) a low-molecular-weight alkylene polymer obtained by radical polymerization of an alkylene under a high pressure or by polymerization thereof under a low pressure in the presence of a Ziegler catalyst, (ii) an alkylene polymer obtained by thermal decomposition of a high-molecular-weight alkylene polymer or (iii) a synthetic hydrocarbon obtained by hydrogenating the distillation residue of hydrocarbons prepared by the Arge process from a synthesis gas comprised of carbon monoxide and hydrogen. The hydrocarbon wax is fractionated by a fractional crystallization system utilizing press-sweating, solvent dewaxing or vacuum distillation. That is, the hydrocarbon wax includes those obtained by removing low-molecular-weight components, those obtained by extracting low-molecular-weight components, or those obtained by further removing low-molecular-weight components from these, using any of these processes.

The hydrocarbons, serving as a matrix, may include i) hydrocarbons synthesized by reacting carbon monoxide with hydrogen in the presence of metal oxide type catalyst (usually two or more kinds of catalysts), as exemplified by hydrocarbons of about several hundred carbon atoms (end products are formed by finally carrying out hydrogenation) obtained by the Synthol method, the Hydrocol process (making use of a fluidized catalyst bed) or the Arge process (making use of a fixed catalyst bed), the latter provides waxy hydrocarbons in a large quantity, and ii) hydrocarbons obtained by polymerizing alkylenes such as ethylene in the presence of a Ziegler catalyst, all of which are preferable as having less branches and being saturated long straight chain hydrocarbons. In particular, hydrocarbon waxes synthesized by the method not relying on the polymerization of alkylenes are preferred in view of their structure and their molecular weight distribution readily feasible for fractionation. As preferable ranges of the molecular weight distribution of the hydrocarbon wax used in the present invention, the hydrocarbon wax may have a number average molecular weight (Mn) of preferably from 550 to 1,200, and more preferably from 600 to 1,000, a weight average molecular weight (Mw) of preferably from 800 to 3,600, and more preferably from 900 to 3,000, and Mw/Mn of preferably not more than 3, more preferably not more than 2.5, and still more preferably not more than 2.0. It may also have a distribution peak in the region of a molecular weight of from 700 to 2,400, preferably from 750 to 2,000, and particularly preferably a molecular weight of from 800 to 1,600. The hydrocarbon wax having such a molecular weight distribution can impart preferable thermal properties to the toner. More specifically, if the molecular weight corresponding to the distribution peak is smaller than the above range, the toner becomes to sensitive to thermal influence, resulting in smearing of MICR characters due to rubbing against the magnetic head when the MICR printed paper is passed through an MICR reader-sorter as well as the contamination of the magnetic head. If that molecular weight is larger than the above range, the toner may exert poor fixing performance, undesirably resulting in frequent falling-off of MICR characters when the MICR printed paper is passed through an MICR reader-sorter.

As other physical properties possessed by the hydrocarbon wax used in the present invention, the hydrocarbon wax may preferably have a density of 0.95 ($g/cm^3$) at 25° C. and also may preferably have a penetration of 1.5 ($10^{-1}$ mm) or less, and more preferably 1.0 ($10^{-1}$ mm). If the properties are outside these ranges, the toner tends to change at low temperature, resulting in smearing of MICR characters when the MICR printed paper is passed through an MICR reader-sorter as well as the contamination of the magnetic head.

The hydrocarbon wax should also preferably have a melt viscosity of 100 cP or less, more preferably 50 cP or less, and still more preferably 20 cP or less, at 140° C. If this melt viscosity is more than 100 cP, the toner may have poor plasticity and releasability, tending to cause smearing of MICR characters when the MICR printed paper are passed through an MICR reader-sorter and also tending to cause contamination of the magnetic head.

The hydrocarbon wax should also preferably have a softening point of 130° C. or below, and more preferably 120° C. or below. If this softening point is higher than 130° C., the temperature at which the releasability is efficiently exerted becomes higher, so that the releasability becomes rather poor, tending to cause smearing of MICR characters.

The hydrocarbon wax should preferably have an acid value of less than 2.0 mg KOH/g, and more preferably less than 1.0 mg KOH/g. If the acid value is higher than this range, its interfacial adhesion to the binder resin, a component of the toner, may become so large that the phase separation at the time of melting often becomes unsatisfactory, making good releasability difficult, causing smearing of MICR characters when the MICR printed paper is passed through an MICR reader-sorter as well as the contamination of the magnetic head of the MICR reader-sorter.

The hydrocarbon wax should preferably be used in a content of not more than 20 parts by weight based on 100 parts of the binder resin. More preferably, it can be effectively used in a content of from 0.5 to 10 parts by weight.

In the present invention, the molecular weight distribution of the hydrocarbon wax is measured by gel permeation chromatography (GPC) under the following conditions.

GPC Measurement Conditions

Apparatus: GPC-150 (Waters Co.)

Columns: GMH-HT 30 cm, two series (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Measured under conditions described above. Molecular weight of the sample is calculated using a molecular weight calibration curve prepared from a monodisperse polystyrene standard sample. It is calculated by further converting the value in terms of polyethylene according to a conversion formula derived from the Mark-Houwink viscosity formula.

The needle penetration value of wax in the present invention is a value measured according to JIS K-2207. Stated specifically, it is a numerical value corresponding to the depth of penetration measured when a sample is penetrated by a needle having a diameter of about 1 mm and a conical tip with a vertical angle of 9° under a given load, and expressed in units of 0.1 mm. Test conditions in the present invention are as follows: Sample temperature: 25° C.; load: 100 g; and penetration time: 5 seconds.

The melt viscosity in the present invention is a value measured using a Brookfield viscometer, under conditions of a measuring temperature of 140° C., shear rate of 1.32 rpm and sample quantity of 10 ml.

The acid value is milligrams of potassium hydroxide necessary to neutralize the acid radicals contained in 1 g of a sample (according to JIS K5920). The density is a value measured at 25° C. according to JIS K6760, and the softening point is a value measured according to JIS K2207.

In the present invention, it is a characteristic feature that the hydrocarbon wax satisfies the properties that, in the DSC curve measured using a differential scanning calorimeter, the onset temperature of an endothermic peak is within the range of from 50° C. to 90° C., at least one endothermic peak P1 is present in a temperature range of from 90° C. to 120° C. and the largest exothermic peak during temperature lowering is present within ±9° C. of the peak temperature of the endothermic peak P1. Its use in combination with a magnetic material having specific magnetic properties as described later can achieve the objects previously stated.

During temperature rise, change of wax conditions on heat application can be seen, and endothermic peaks due to transition and melting of the wax component are observed. When the onset temperature of an endothermic peak during temperature rise is within the range of from 50 to 90° C., an excellent release effect prevents the smearing or falling-off of MICR characters even when the MICR printed paper is repeatedly passed through an MICR reader-sorter as well as the contamination of the magnetic head of the MICR reader-sorter.

If this onset temperature of a peak during temperature rise is lower than 50° C., the wax changes at a temperature so low, that the smearing of MICR characters and the contamination of the magnetic head of the MICR reader-sorter tend to occur when the MICR printed paper is passed through an MICR reader-sorter.

If the onset temperature of the peak is higher than 90° C., the wax may change at a temperature so high, that the falling-off of MICR characters when the MICR printed paper is passed through an MICR reader-sorter.

The hydrocarbon wax used in the present invention is also characterized in that the endothermic peak during temperature rise is present in the range of from 90 to 120° C., preferably in the range of from 95 to 120° C., and more preferably in the range of from 97 to 115° C. That is, the wax melts in this temperature region brings about a release effect preventing the smearing of MICR characters and the contamination of the magnetic head of the MICR reader-sorter even when the MICR printed paper is repeatedly passed through an MICR reader-sorter.

If the endothermic peak during temperature rise is present only in a region lower than 90° C., a plasticizing effect due to the melting of wax may be exerted at a low temperature resulting in considerable decrease in mechanical strength of the binder resin. In such a case, when the MICR-printed paper is passed through an MICR reader-sorter, the release effect would work, but the decrease of mechanical strength of the binder resin undesirably causes the smearing of MICR characters when they rub against the magnetic head of the MICR reader-sorter as well as the contamination of the magnetic head.

The endothermic peaks during temperature rise may also be present in a region higher than 120° C. If, however, the endothermic peaks are present only in the temperature region higher than 120° C., the wax has an excessively high melting temperature, which means increased releasability from paper in MICR printing, which causes falling-off of MICR characters when rubbd against the magnetic head during passing through an MICR reader-sorter as well as the contamination of the magnetic head. On the other hand, if the largest endothermic peak is present at a temperature lower than 90° C., the wax behaves as if the endothermic peak is present only in this region. Therefore endothermic peaks may be present in this region, but they must be smaller than the endothermic peak present in the range of from 90 to 120° C.

During temperature lowering, changes of wax on cooling and condition thereof at room temperature can be seen. The observed exothermic peaks are ascribed to solidification, crystallization and transition of wax. The largest exothermic peak observed during temperature lowering is an exothermic peak ascribed to solidification and crystallization of the wax. The closer the temperature of an endothermic peak ascribable to melting during temperature rise is to this exothermic peak temperature, the more homogeneous the wax is, from the viewpoint of its physical properties such as crystal structure and molecular weight distribution. In the present invention, its difference should be within 9° C., preferably within 7° C., and more preferably within 5° C. More specifically, the smaller difference is, the sharper melt performance the wax has. In other words, the wax is hard at the time of low temperature, rapidly melts at the time of melting and greatly decreases melting viscosity, so that a good release effect can be brought about, which prevents the falling-off of MICR characters even when the MICR printed paper is repeatedly passed through an MICR reader-sorter as well as the contamination of the magnetic head of the MICR reader-sorter. In the present invention, the maximum exothermic peak of the hydrocarbon wax should be present in the temperature region of from 85 to 115° C., and preferably from 90 to 110° C.

In DSC measurement of the wax, which corresponds to the case of the toner previously described, each temperature is defined as follows:

Endothermic Peak

Onset temperature of a peak is defined as the lowest temperature at which the differential of the curve is extreme. Thus, the definition is different from that of the onset temperature of the toner.

Peak temperature is the peak top temperature.

Exothermic Peak

Peak temperature is the peak top temperature of the largest peak.

The hydrocarbon wax described above should preferably be used in a content of not more than 20 parts by weight based on 100 parts of the binder resin. More preferably, it can be effectively used in a content of from 0.5 to 10 parts by weight. It may also be used in combination with other waxes.

In the present invention, the magnetic material used together in the magnetic toner having the specific thermal properties described above or the magnetic toner containing the hydrocarbon wax having the specific thermal properties described above has the constitution as described below.

The magnetic material according to the present invention may preferably have an average particle diameter of from 0.1 to 0.6 $\mu$m, and should more preferably have an average particle diameter of from 0.15 to 0.4 $\mu$m. In the present invention, the average particle diameter is determined in the following way: An photograph of a sample is taken by 2,000 magnification using a scanning electron microscope, and the length (major axis) of 100 to 200 particles are measured at random and an average value thereof is calculated.

The magnetic material used in the magnetic developer of the present invention has a residual magnetization $\sigma r$ in the range of $12 \leqq \sigma r \leqq 30$ emu/g, and preferably in the range of $14 \leqq \sigma r \leqq 28$ emu/g, in a magnetic field of 10,000 oersteds.

Use of a magnetic material having a residual magnetization $\sigma r$ of less than 12 emu/g may result in considerable decrease of the recognition rate of printed MICR characters using an MICR reader-sorter.

A magnetic material having a residual magnetization $\sigma r$ of more than 30 emu/g tends to bring about a low image density as well as the fog phenomenon, therefore resulting in considerable decrease in the recognition rate of MICR characters printed with such a magnetic developer, as well as extremely low image quality when ordinary characters are printed. The magnetic material according to the present invention has a coercive force Hc in the range of $130 \leqq Hc \leqq 300$ oersteds, and preferably in the range of $140 \leqq Hc \leqq 280$ oersteds, in a magnetic field of 10,000 oersteds. A magnetic material having a coercive force Hc of less than 130 oersteds brings about a high image density but on the other hand a poor fine-line reproduction, undesirably causing a decrease in the recognition rate when MICR characters are printed. A magnetic material having a coercive force Hc of more than 300 makes it difficult for the magnetic developer to be uniformly spread on the developing sleeve, undesirably causing a decrease in image density or an uneven density.

In the present invention, the magnetic toner should contain the magnetic material preferably in an amount of from 40 to 120 parts by weight, and more preferably from 50 to 110 parts by weight, based on 100 parts by weight of the binder resin.

The magnetic material used in the present invention may preferably be produced by synthesis carried out by the wet process using an aqueous solution containing $Fe^{2+}$, i.e., ferrous sulfate as a starting material, followed by oxidation and reduction at temperatures of 200° C. or above. More specifically, it is produced by the above wet process, followed by thermal oxidation and then thermal reduction at temperatures of 200° C. or above. The thermal oxidation may preferably be carried out at 500 to 900° C. under aeration of oxidizing gas such as air, and then the thermal reduction may preferably be carried out at 250 to 550° C. under aeration of reducing gas such as hydrogen and/or carbon monoxide.

In the magnetic developer of the present invention, a charge control agent may preferably be used by compounding it into toner particles (internal addition) or blending it with toner particles (external addition).

A positive charge control agent usable in the present invention may include Nigrosine and products modified with a fatty acid metal salt; quaternary ammonium salts such as tributylbenzylammonium 1-hydroxy-4-naphthosulfonate and tetrabutylammonium tetrafluoroborate; diorganotin oxides such as dibutyltin oxide, dioctyltin oxide and dicyclohexyltin oxide; and diorganotin borates such as dibutyltin borate, dioctyltin,borate and dicyclohexyltin borate; any of which may be used alone or in combination of two or more kinds. Of these, Nigrosine type or quaternary ammonium salt type charge control agents may particularly preferably be used.

Homopolymers of monomers represented by the formula:

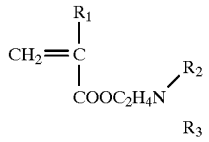

$R_1$:H or $CH_3$ $R_2$, $R_3$: a substituted or unsubstituted alkyl group, preferably $C_1$ to $C_4$;

or copolymers of polymerizable monomers such as styrene, acrylates or methacrylates as described above may also be used as a positive charge control agent. In this case, these charge control agents can also act as a binder resins (as a whole or in part).

As a negative charge control agent usable in the present invention, for example, organic metal complexes of monoazo dyes, or salts thereof, and metal complexes of salicylic acid, alkyl salicylic acids, dialkyl salicylic acids or naphthoic acid, or salts thereof, are preferably used.

Among the charge control agents described above (those having no action as binder resins) may preferably be used in the form of fine particles. In this case, the charge control agent may preferably have a number average particle diameter of specifically 4 $\mu$m or less, and more preferably 3 $\mu$m or less.

When internally added to the toner, such a charge control agent may preferably be used in an amount of from 0.1 part to 10 parts by weight, and more preferably from 0.1 part to 5 parts by weight, based on 100 parts by weight of the binder resin.

The magnetic developer of the present invention may preferably have fine silica powder.

The fine silica powder here includes anhydrous silicon dioxide (colloidal silica) as well as a silicate such as aluminum silicate, sodium silicate, potassium silicate, magnesium silicate or zinc silicate.

Of the above fine silica powders, a fine silica powder having a surface specific area, as measured by the BET method using nitrogen absorption, in the range of from 70 to 300 $m^2/g$ can give good results. The fine silica powder should preferably be used in an amount of from 0.2 part to 1.6 parts by weight, and more preferably from 0.4 part to 1.4 parts by weight, based on 100 parts by weight of the magnetic toner.

When the magnetic toner of the present invention is used as a positively chargeable toner, a positively chargeable fine silica powder, rather than a negatively chargeable one, may more preferably be added for the purpose of preventing wear of toner or preventing contamination or damage of sleeve surface, since the charge stability also is not damaged.

To obtain the positively chargeable fine silica powder, there are a method in which the untreated fine silica powder described above is treated with a silicone oil having an organo group having at least one nitrogen atom on its side chain, or a method to treat with a nitrogen-containing silane coupling agent, or a method to treat with both of these.

When the magnetic toner of the present invention is used as a negatively chargeable toner, a fine silica powder having a triboelectricity of from −100 $\mu c/g$ to −300 $\mu c/g$ may preferably be used. A fine silica powder having a triboelectricity of less than −100 $\mu c/g$ may decrease the triboelectricity of the developer itself, resulting in inferior humidity characteristics. Use of a fine silica powder of more than −300 $\mu c/g$ triboelectricity may promote the memory of the developer carrying member and also may increase the influence of deteriorated silica, bringing about a difficulty in running performance. A silica powder finer than 300 $m^2/g$ is not effective when added to the developer, and a silica powder coarser than 70 $m^2/g$ is liable to separate, often causing black dots due to segregation or agglomerates of silica.

Triboelectric values of the fine silica powder is measured in the following way: A silica fine powder left to stand overnight in an environment of a temperature of 23.5° C. and a humidity of 60% RH, and 0.2 g and 9.8 g of an carrier iron powder not coated with a resin and having a main particle size at 200 to 300 meshes (e.g., EFV200/300, available from Nihon Teppun K.K.) are precisely weighed into 50 ml jars made of polyethylene respectively in the above environment, and thoroughly mixed by manually shaking in the vertical direction about 50 times for about 20 seconds.

Figure 15:
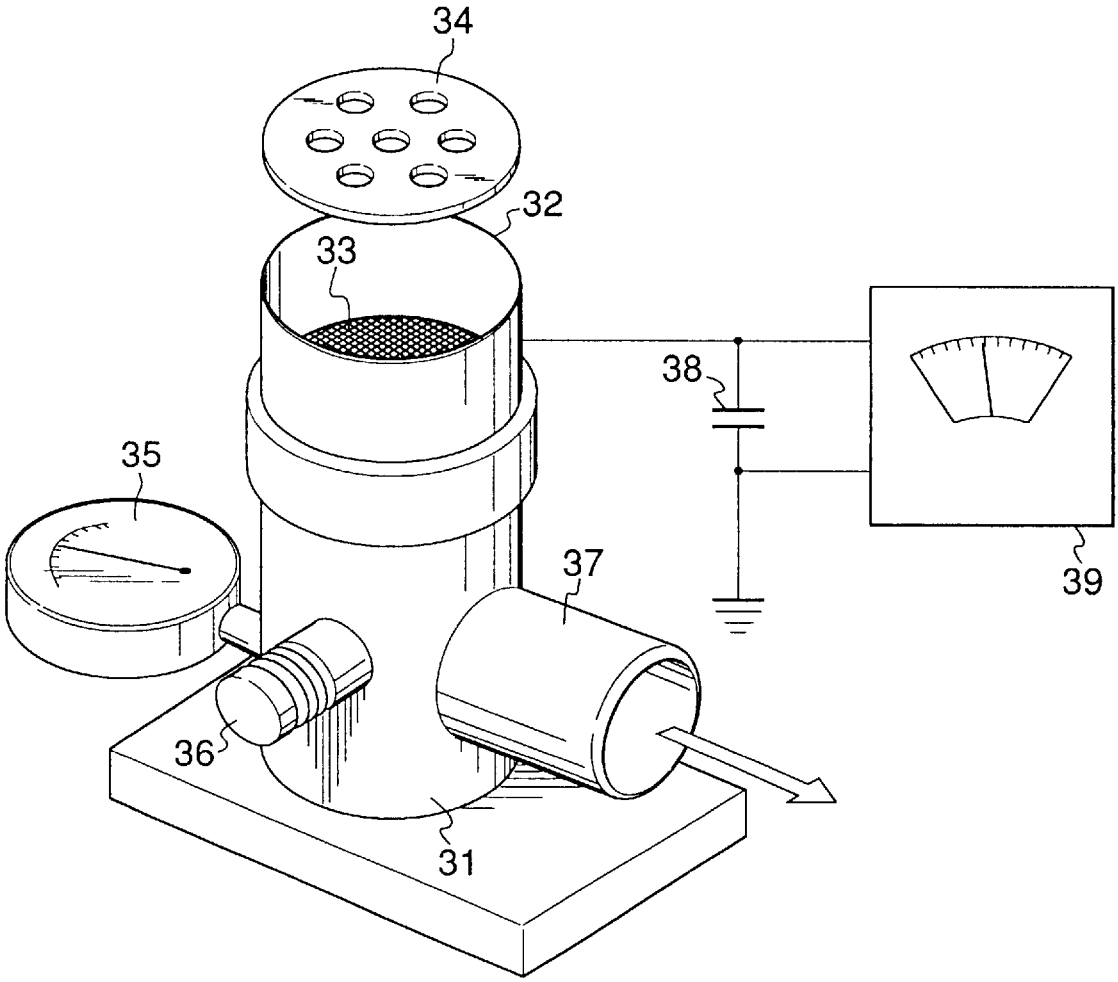
FIG. 15 illustrates an apparatus for measuring quantity of triboelectricity of toner.

Next, as shown in FIG. 15, 0.5 g of the mixture is put in a measuring container 32 made of a metal at the bottom of which is provided a screen 33 of 400 meshes and the container is covered with a plate 34 made of a metal. The total weight of the measuring container 32 in this state is weighed and is expressed by $W_1$ (g). Next, in a suction device 31 (made of an insulating material at least at the part coming into contact with the measuring container 32), air is evacuated from a suction opening 37 and an air-flow control valve 36 is operated to control the pressure indicated by a vacuum indicator 35 to be 250 mmHg. In this state, suction is sufficiently carried out to remove the silica by suction. The potential indicated by a potentiometer 39 at this time is expressed by V (volt). Reference numeral 38 denotes a capacitor, whose capacitance is expressed by C ($\mu$F). The total weight of the measuring container after completion of the suction is also weighed and is expressed by $W_2$ (g). The quantity of triboelectricity ($\mu$C/g) of the silica is calculated as shown by the following equation.

$$\text{Quantity of triboelectricity} = C \times V/(W_1 - W_2)$$

The magnetic toner used in the present invention may be optionally mixed with additives. As a colorant, conventionally known dyes and pigments can be used. It may usually be used in an amount of 0.5 part to 20 parts by weight based on 100 parts by weight of the binder resin. As other external additives, a lubricant as exemplified by zinc stearate, an abrasive such as cerium oxide or silicon carbide, a fluidity-providing and anti-caking agent as exemplified by aluminum oxide, and a conductivity-providing agent as exemplified by carbon black or tin oxide can be used in the magnetic developer of the present invention.

The magnetic developer according to the present invention can be produced in the following way: A magnetic powder and a vinyl or non-vinyl type thermoplastic resin, optionally together with a pigment or dye as a coloring agent, a charge control agent and other additives, are thoroughly mixed using a mixing machine such as a ball mill, and then the mixture is melt-kneaded using a heat kneading machine such as a heating roll, a kneader or an extruder to melt the resin etc., in which a pigment or dye is then dispersed or dissolved, followed by cooling for solidification and thereafter pulverization and strict classification. Thus, the insulating magnetic toner according to the present invention can be obtained.

Figure 16:
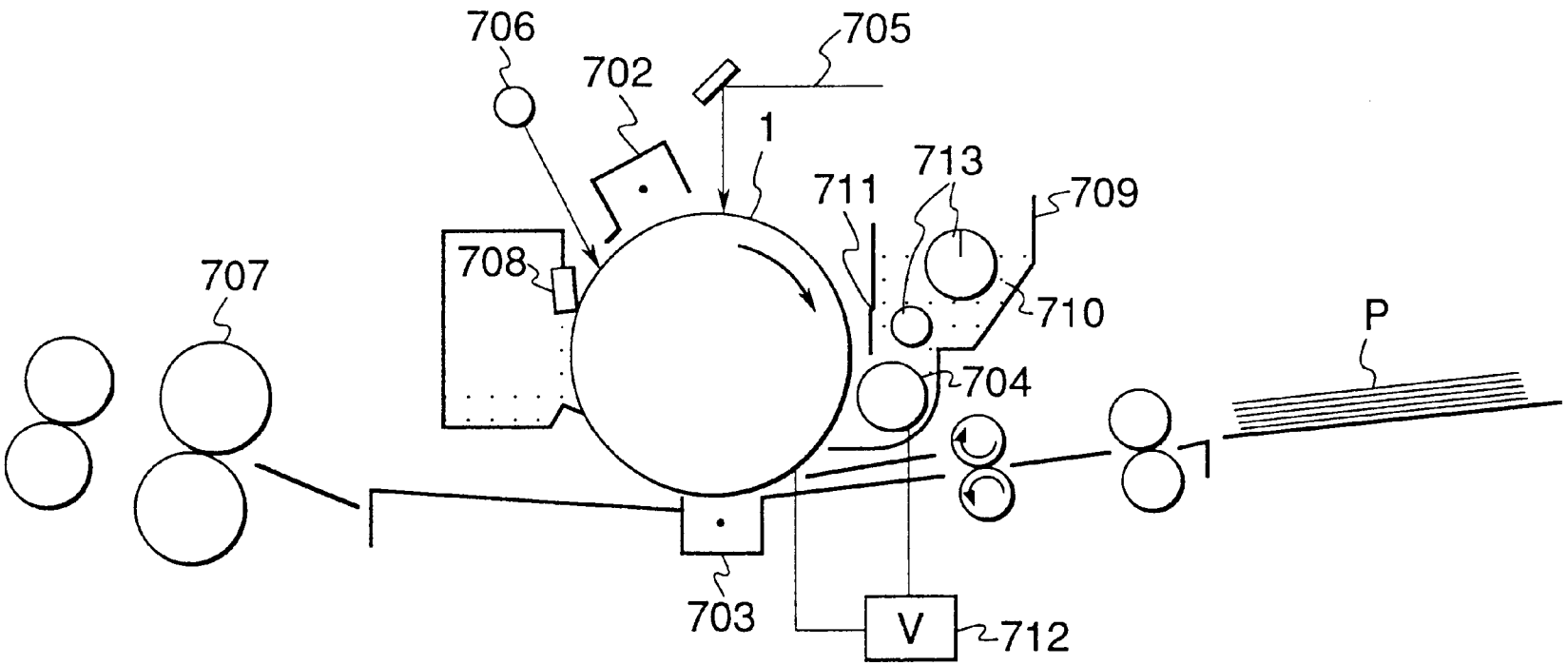
FIG. 16 is a diagrammatic view to illustrate an electrophotographic apparatus in which the magnetic developer of the present invention is used.

An electrophotographic appparatus and a device unit in which the magnetic developer of the present invention is used will be described below with reference to FIG. 16.

The surface of a photosensitive member is negatively charged by the operation of a primary corona assembly 702 (a charging means), and a digital latent image is formed by image scanning through optical image exposure 705 (slit exposure, laser beam scanning exposure). The latent image thus formed is reversally developed using a one-component magnetic developer 710 held in a developing assembly (a developing means) 709 equipped with a magnetic blade 711 and a developing sleeve 704 having a magnet 714 inside. In a developing zone, an AC bias, a pulse bias and/or a DC bias is/are applied across a conductive substrate of a photosensitive drum (a photosensitive member) 1 and the developing sleeve 702 through a bias applying means 712. A transfer paper P is fed and delivered to the transfer zone, where the transfer paper P is charged by means of a secondary corona assembly (a transfer means) 703 from its back surface (the surface opposite to the photosensitive drum), so that the developed image (a toner image) formed on the surface of the photosensitive drum is electrostatically transferred to the transfer paper P. The transfer paper P separated from the photosensitive drum 701 is subjected to fixing using a heat-pressure roller fixing assembly 707 so that the toner image on the transfer paper can be fixed.

The one-component developer remaining on the photosensitive drum 1 after the transfer step is removed by the operation of a cleaning assembly (a cleaning means) 708 having a cleaning blade. After the cleaning, the residual charges on the photosensitive drum 1 are eliminated by erase exposure 706, and thus the procedure again starts from the charging step using the primary corona assembly 702.

An electrostatic latent image bearing member (the photosensitive drum) comprises a photosensitive layer and a conductive substrate, and is rotated in the direction of an arrow. In the developing zone, the developing sleeve 704, a non-magnetic cylinder, which is a toner carrying member, is rotated so as to move in the same direction as the direction in which the electrostatic latent image bearing member is rotated. In the inside of the non-magnetic cylindrical developing sleeve 704, a multi-polar permanent magnet (a magnet roll) serving as a magnetic field generating means is provided in an unrotatable state. The one-component insulating magnetic developer 710 held in the developing assembly 709 is spread on the surface of the non-magnetic cylindrical developing sleeve, and, for example, negative triboelectric charges are imparted to toner particles because of the friction between the surface of the sleeve 704 and the toner particles. A magnetic doctor blade 711 made of iron is disposed opposingly to one of the magnetic pole positions of the multi-polar permanent magnet, in proximity (with a space of 50 μm to 500 μm) to the surface of the cylinder. Thus, the thickness and the uniformity of the developer layer can be controlled (from 30 μm to 300 μm) so that the developer layer thinner than the gap between the electrostatic latent image bearing member 1 and the toner carrying member 704 in the developing zone can be formed on the sleeve in a non-contact state. The rotational speed of this toner carrying member 704 may preferably be regulated so that the peripheral speed of the sleeve can be substantially equal or close to the speed of the peripheral speed of the surface on which electrostatic images are retained. As the magnetic doctor blade 711, a permanent magnet may be used in place of iron to form an opposing magnetic pole. In the developing zone, the AC bias or pulse bias may be applied through the bias means 712, across the toner carrying member 704 and the surface on which electrostatic images are retained. This AC bias may have a frequency (f) of 200 Hz to 4,000 Hz, and a Vpp of 500 V to 3,000 V.

The toner particles are moved in the developing zone to the side of the electrostatic image by the electrostatic force of the electrostatic image retaining surface and the action of the AC bias or pulse bias.

In place of the magnetic doctor blade 711, an elastic blade made of an elastic material such as silicone rubber may be used so that the layer thickness of the developer layer can be controlled by pressure and the toner can be thereby spread on the developer carrying member.

In the electrophotographic apparatus, plural components selected from among the constituents such as the above photosensitive member, developing means and cleaning means,may be integrally joined as one device unit, so that the unit is detachable from the body of the apparatus. For example, the developing means and the photosensitive member may be integrally supported to form one unit detachable from the main body of the apparatus using a guide means such as a rail provided in the body of the apparatus. Here, the above device unit may be so constituted as to be joined together with the charging means and/or the cleaning means.

When the electrophotographic apparatus is used as a copying machine or a printer, the optical image exposure L is carried out by irradiation with light reflected from, or transmitted through, an original, or by the scanning of a laser beam, the driving of an LED array or the driving of a liquid crystal shutter array according to signals obtained by reading an original and converting the information into signals.

The method of magnetic-ink character printed with the magnetic developer of the present invention will be described.

Figure 17:
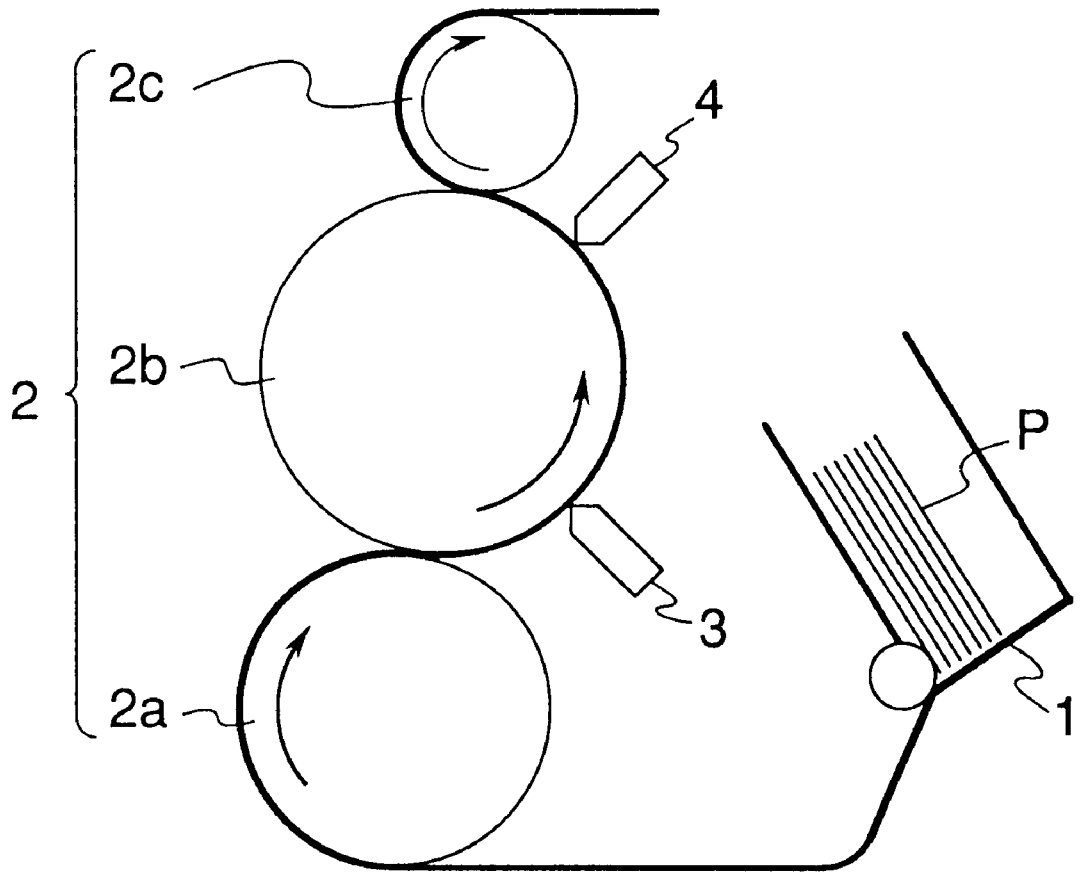
FIG. 17 is a diagrammatic view to illustrate the method of magnetic-ink character recognition of the present invention.

FIG. 17 illustrates an apparatus used in the process of magnetic-ink character recognition of the present invention. Reference numeral 1 denotes a hopper that holds recording paper P; 2, a transport means having rollers 2*a*, 2*b* and 2*c*; 3, a writing head that imparts magnetism to toner images on the recording paper; and 4, a reading head serving as a reading means for reading the magnetism thus imparted.

Figure 18:
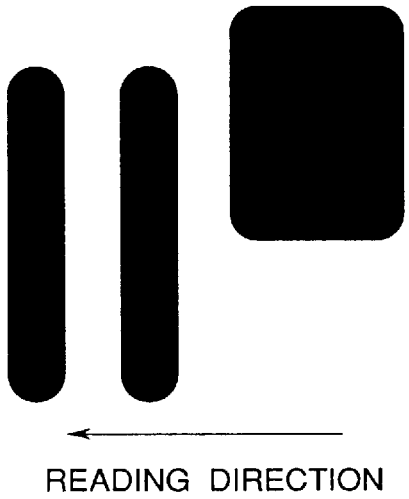
FIG. 18 is a view to illustrate "ON-US" symbols printed as MICR characters for evaluating fine-line reproduction.

Recording paper P having ink symbols (ON-US characters) as shown in FIG. 18, formed by a magnetic toner is transported from the hopper 1 through the rollers 2*a*, 2*b* and 2*c* of the transport means 2, and magnetism is imparted to the ink symbols by means of the writing head 3. The magnetism imparted to the ink symbols is read by the reading head 4 and the proper waveform of the ink symbols is recognized.

In the present invention, the specific hydrocarbon wax is incorporated in the magnetic developer so that the magnetic developer can be endowed with preferable thermal properties. Hence, its use in combination with the magnetic material having the specific magnetic properties brings about the following good effects.

The present invention can provide a magnetic developer that may cause no smearing or falling-off of MICR characters even when the MICR printed paper is repeatedly passed through an MICR reader-sorter, and a method of magnetic-ink character printed with such a magnetic developer.

The present invention can provide a magnetic developer that may cause no soil or contamination of the magnetic head of an MICR reader-sorter even when the MICR printed paper is repeatedly passed through the MICR reader-sorter, and a method of magnetic-ink character printed with such a magnetic developer.

The present invention can provide a magnetic developer that can form a toner image with superior resolution, gradation and fine-line reproduction even in an image forming apparatus in which a latent image is formed according to digital image signals and the latent image is developed by a reversal development system, and a method of magnetic-ink character printed with such a magnetic developer.

The present invention can provide a magnetic developer that can show a superior recognition rate when used in MICR printing utilizing an electrophotographic printer, and a method of magnetic-ink character printed with such a magnetic developer.

The present invention can provide a magnetic developer that may cause no decrease in the recognition rate even when the MICR printed paper is repeatedly passed through an MICR reader-sorter, and a method of magnetic-ink character printed with such a magnetic developer.

The present invention can provide a magnetic developer that can achieve superior fine-line reproduction and resolution, and can faithfully reproduce MICR characters according to the standard, and a method of magnetic-ink character printed with such a magnetic developer.

The present invention will be specifically described below by giving Examples. These by no means limit the present invention. In the formulation in Examples, "part(s)" and "%" refer to "part(s) by weight" and "% by weight", respectively, unless particularly noted.

Preparation of Waxes A to H

Hydrocarbon waxes A to H used in the present invention were prepared in the following way.

A hydrocarbon wax synthesized by the Arge process from a synthesis gas of carbon monoxide and hydrogen was designated as wax F (a comparative example), from which wax A (the present invention), wax B (the present invention) and wax C (the present invention) were obtained by fractional crystallization.

The hydrocarbon synthesized by the Arge process from a synthesis gas of carbon monoxide and hydrogen was treated by oxidation to give wax G (a comparative example).

In the presence of a Ziegler catalyst, ethylene was polymerized at a low pressure to give wax H (a comparative example) with a relatively low molecular weight, which was then subjected to fractional crystallization to give wax D (the present invention) in which low-molecular-weight components had been removed to some extent.

Wax I (a comparative example) having a higher molecular weight than that in the polymerization carried out to synthesize wax H was obtained, from which low-molecular-weight components were extracted by fractional crystallization to give Wax E (the present invention).

Figure 2:
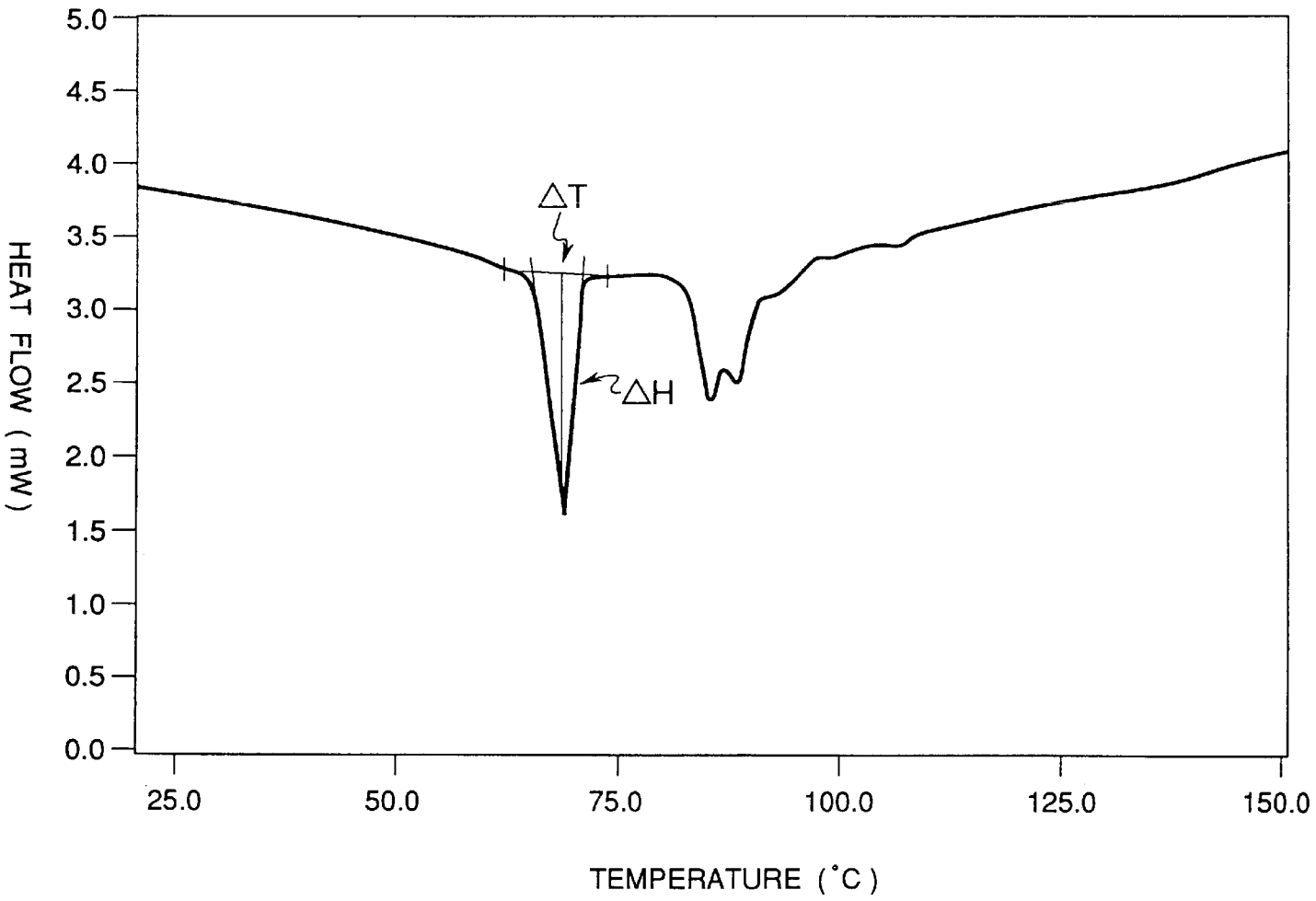
FIG. 2 illustrates the DSC curve during temperature lowering, of magnetic developer 1 according to the present invention.
Figure 3:
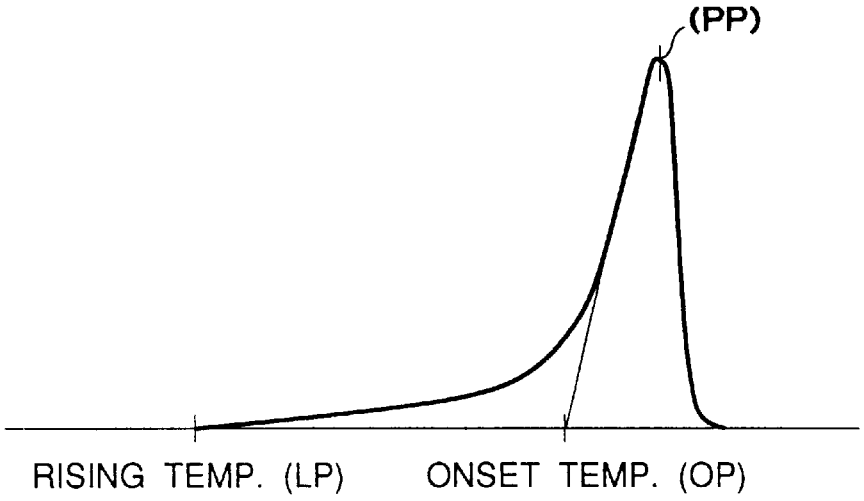
FIG. 3 illustrates an endothermic peak of the DSC curve during temperature rise.
Figure 4:
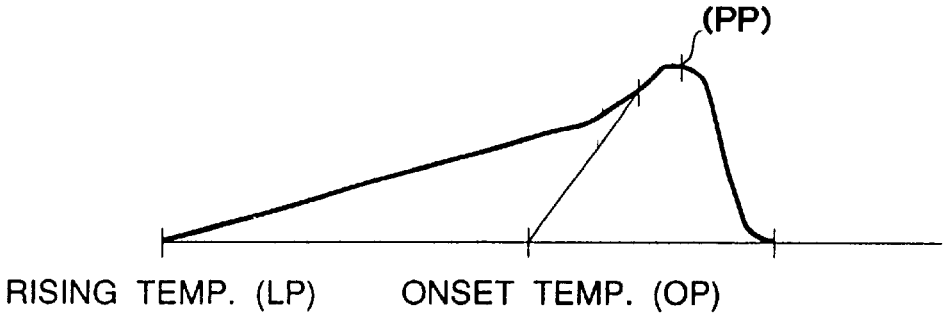
FIG. 4 illustrates an endothermic peak of the DSC curve during temperature rise.
Figure 5:
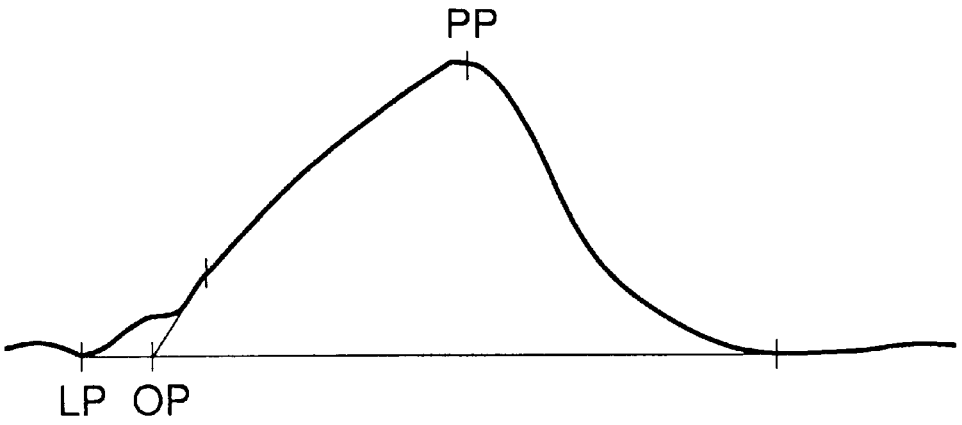
FIG. 5 illustrates an endothermic peak of the DSC curve during temperature rise.
Figure 6:
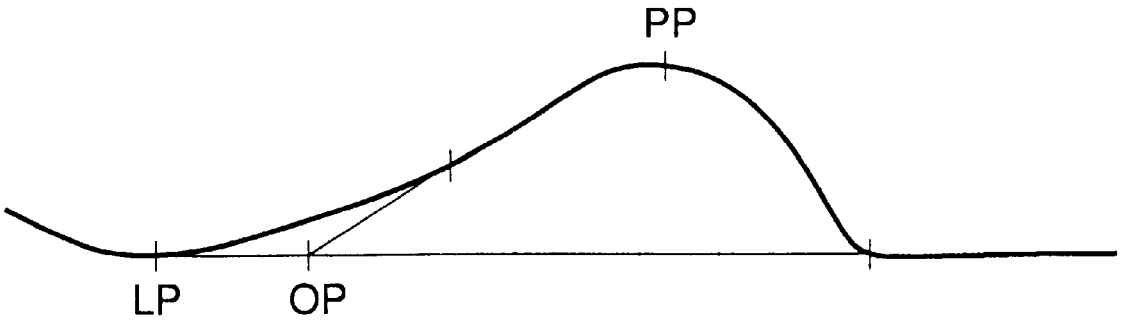
FIG. 6 illustrates an endothermic peak of the DSC curve during temperature rise.
Figure 7:
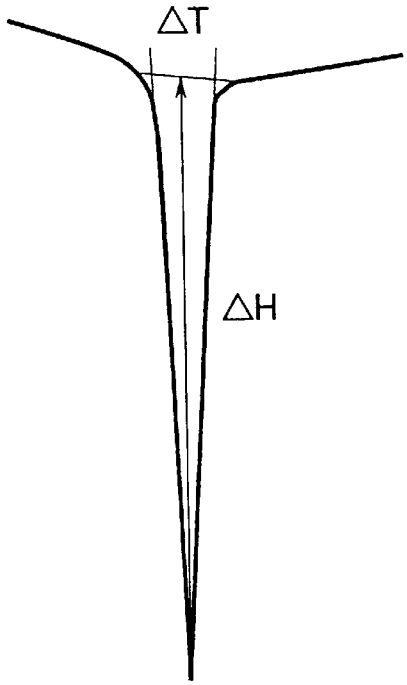
FIG. 7 illustrates an exothermic peak of the DSC curve during temperature lowering.
Figure 8:
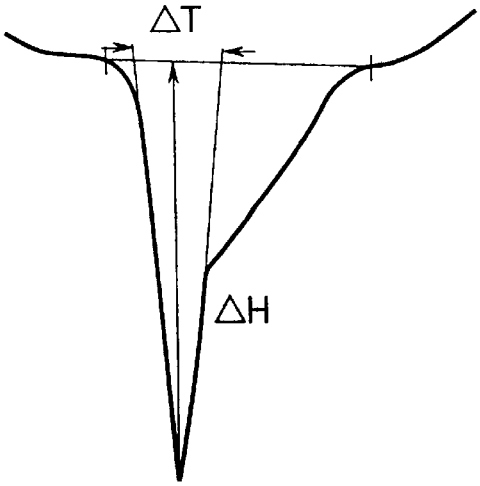
FIG. 8 illustrates an exothermic peak of the DSC curve during temperature lowering.
Figure 9:
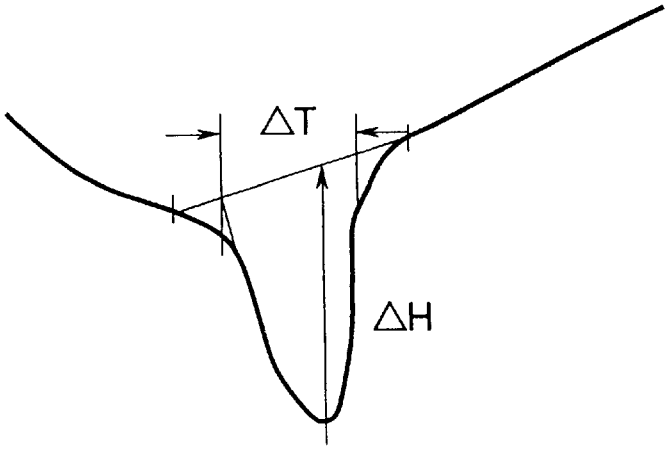
FIG. 9 illustrates an exothermic peak of the DSC curve during temperature lowering.
Figure 10:
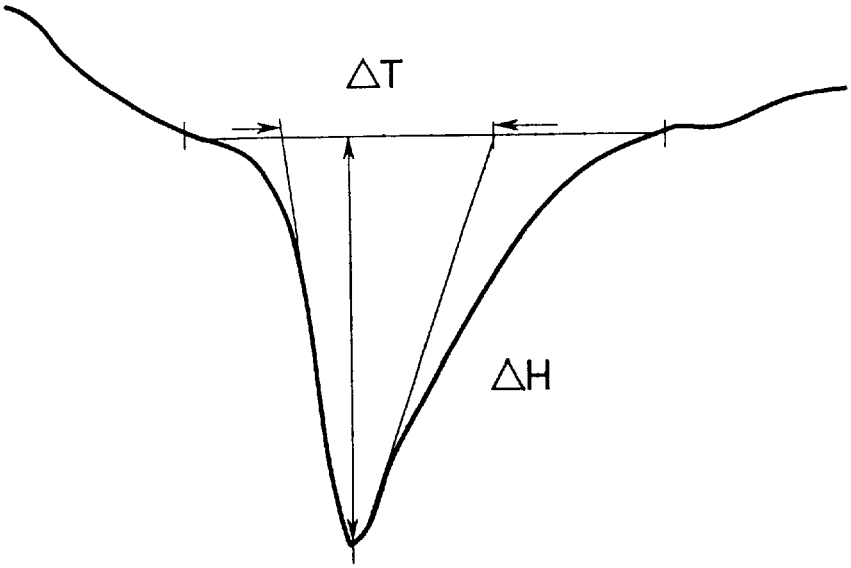
FIG. 10 illustrates an exothermic peak of the DSC curve during temperature lowering.
Figure 11:
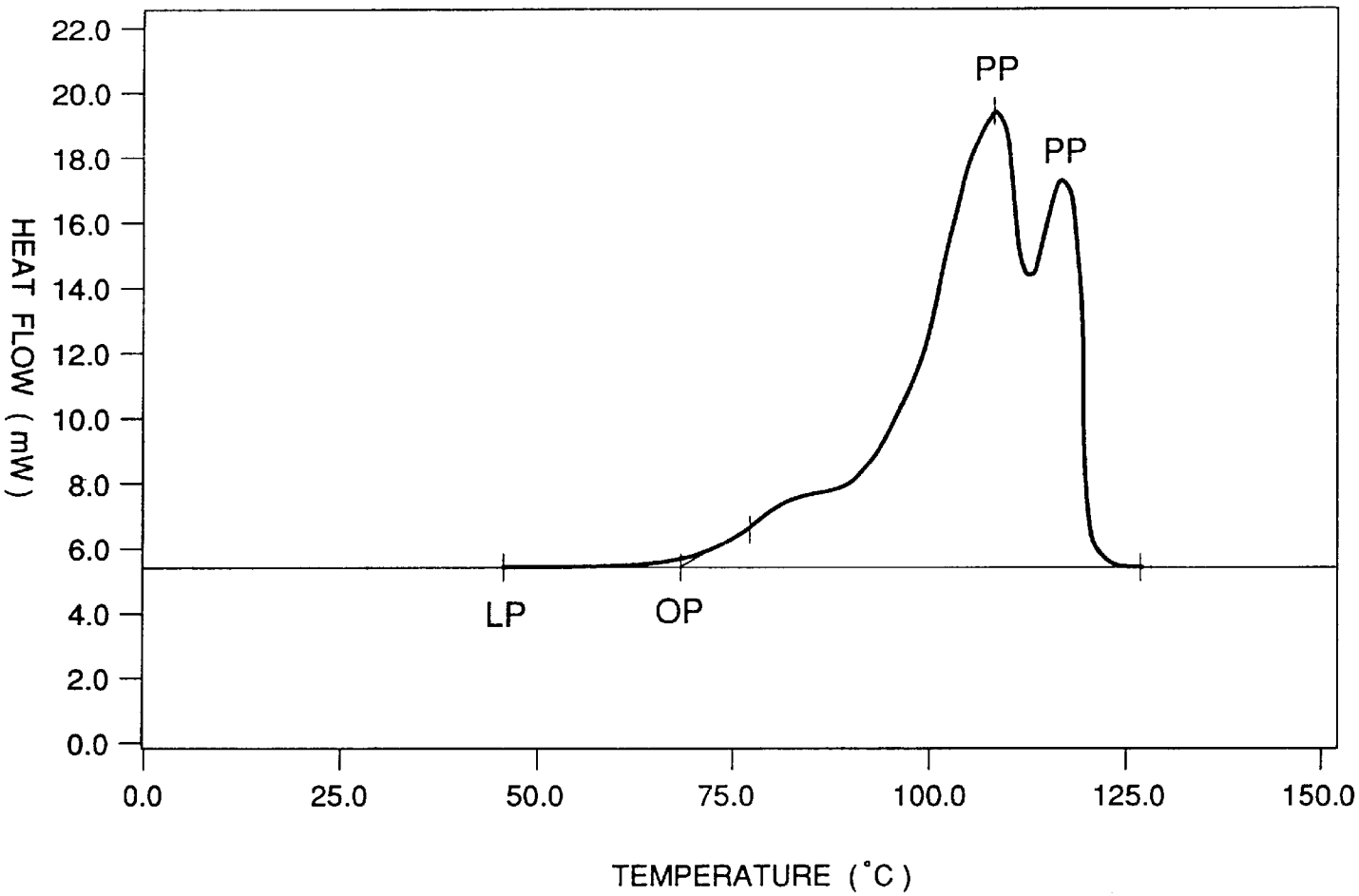
FIG. 11 illustrates the DSC curve during temperature rise, of wax-A according to the present invention.
Figure 12:
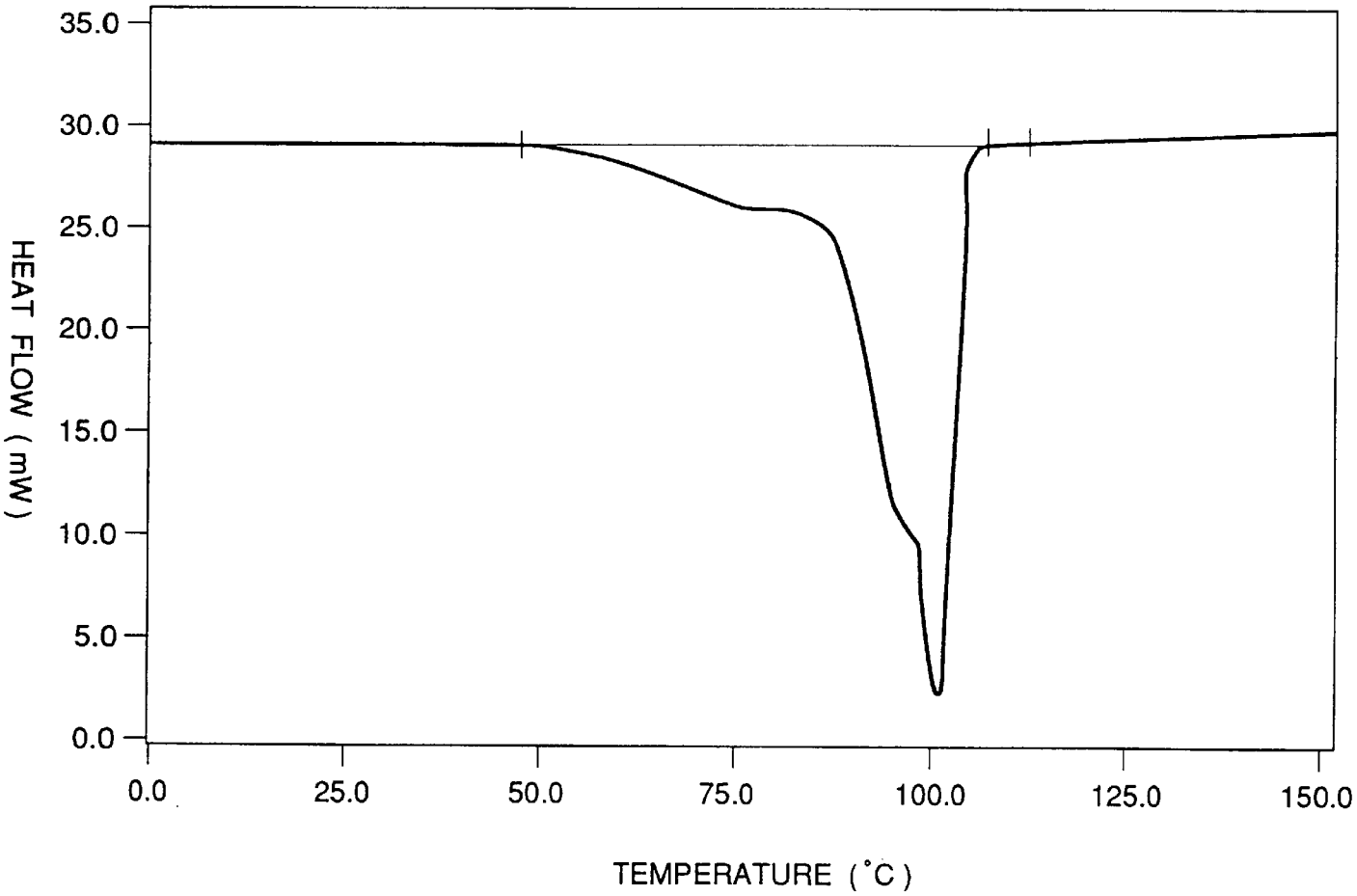
FIG. 12 illustrates the DSC curve during temperature lowering, of wax-A according to the present invention.
Figure 13:
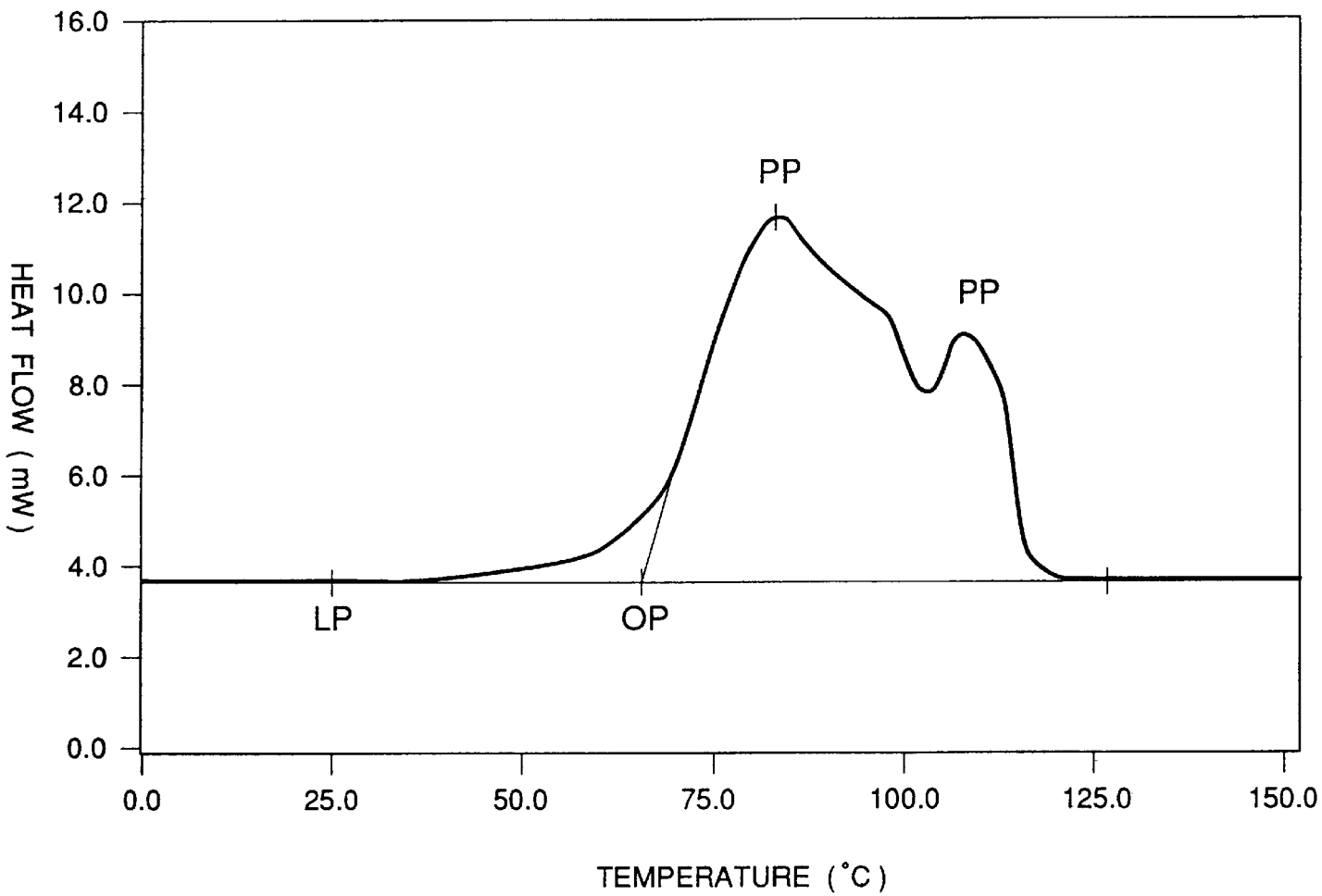
FIG. 13 illustrates the DSC curve during temperature rise, of wax-F (a comparative example).
Figure 14:
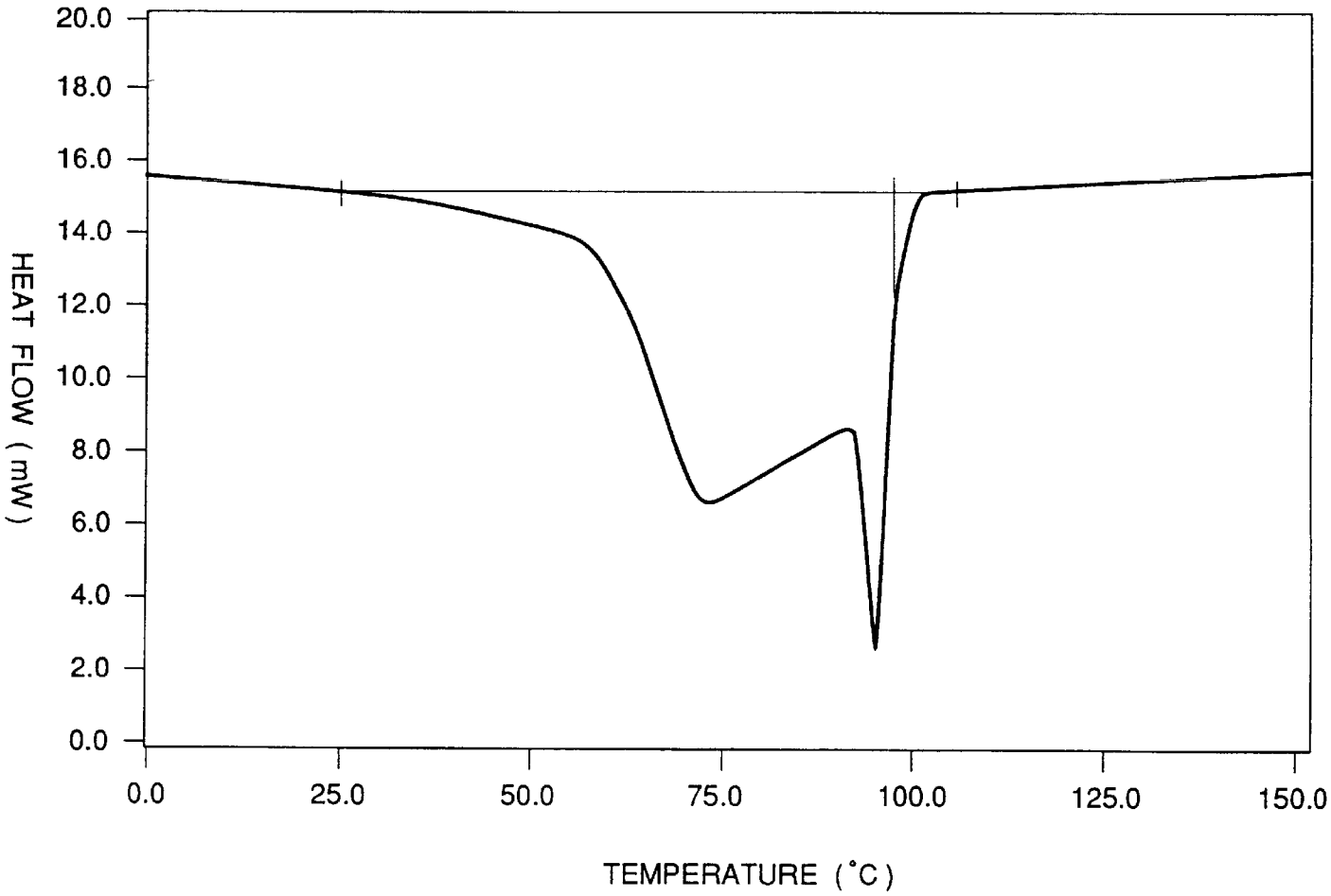
FIG. 14 illustrates the DSC curve during temperature lowering, of wax-F (a comparative example).

DSC characteristics, molecular weight distribution and various physical properties of the waxes A to H obtained in the above are shown in FIGS. 1 to 3.

Preparation of Magnetic Material A

A magnetic material was synthesized by the wet process using ferrous sulfate as a starting material, followed by thermal oxidation carried out at 750° C. under air flow for 2 hours, and then thermal reduction carried out at 350° C. under aeration of hydrogen-nitrogen mixed gas for 3 hours. Thus, magnetic material A as shown in Table 4 was prepared.

Preparation of Magnetic Materials B and C

Magnetic materials B and C as shown in Table 4 were each prepared by the wet process using ferrous sulfate as a starting material.

TABLE 1

DSC Characteristics of Wax

| Wax | At temperature rise: Onset temp. (° C.) | At temperature rise: Endothermic peak temp. (° C.) | At Temperature lowering: Maximum exothermic peak temp. (° C.) | At Temperature lowering: Temperature difference (° C.) |
|---|---|---|---|---|
| Wax A | 65 | 105, 113 | 104 | 1 (105 – 104) |
| Wax B | 67 | 106, 114 | 105 | 1 (106 – 105) |
| Wax C | 61 | 104, 117 | 106 | 2 (106 – 104) |
| Wax D | 63 | 104, 115 | 105 | 1 (105 – 104) |
| Wax E | 83 | 118 | 112 | 6 (118 – 112) |
| Wax F* | 64 | 80, 107 | 97 | 10 (107 – 97) |
| Wax G* | 45 | 102, 114 | 105 | 3 (105 – 102) |
| Wax H* | 97 | 126 | 114 (126 – 114) | 12 |

*Comparative Example
Underlined endothermic peak temp.: Maximum peak

TABLE 2

Molecular Weight Distribution of Wax

| Wax | Number average molecular weight (Mn) | Weight average molecular weight (Mw) | Number average molecular weight/ Weight average molecular weight (Mw/Mn) | Peak Molec. Weight (Mp) |
|---|---|---|---|---|
| Wax A | 760 | 1,250 | 1.64 | 1,120 |
| Wax B | 920 | 1,480 | 1.61 | 1,310 |
| Wax C | 620 | 1,050 | 1.69 | 1,000 |
| Wax D | 580 | 1,150 | 1.98 | 980 |
| Wax E | 610 | 1,680 | 2.75 | 1,590 |
| Wax F* | 540 | 840 | 1.55 | 610 |
| Wax G* | 460 | 1,150 | 2.5 | 500 |
| Wax H* | 760 | 3,100 | 4.07 | 2,500 |

TABLE 2-continued

Molecular Weight Distribution of Wax

| Wax | Number average molecular weight (Mn) | Weight average molecular weight (Mw) | Number average molecular weight/ Weight average molecular weight (Mw/Mn) | Peak Molec. Weight (Mp) |
|---|---|---|---|---|

*Comparative Example

TABLE 3

Physical Properties of Wax

| Wax | Pene-tration ($10^{-1}$ mm) | Density (g/cm$^3$) | Melt viscosity (cp) | Softening point (° C.) | Acid value (mgKOH/g) |
|---|---|---|---|---|---|
| Wax A | 0.5 | 0.96 | 15 | 115 | 0.1 |
| Wax B | 0.5 | 0.96 | 18 | 118 | 0.1 |
| Wax C | 0.5 | 0.96 | 12 | 112 | 0.1 |
| Wax D | 1.5 | 0.95 | 12 | 117 | 0.1 |
| Wax E | 1 | 0.97 | 28 | 124 | 0.1 |
| Wax F* | 1.5 | 0.94 | 10 | 106 | 0.1 |
| Wax G* | 2 | 0.95 | 13 | 118 | 0.1 |
| Wax H* | 1 | 0.97 | 85 | 130 | 0.1 |

*Comparative Example

TABLE 4

| | Residual magneti-zation σr (emu/g) | Coercive force Hc (Oe) | Average particle diameter (μm) |
|---|---|---|---|
| Magnetic material A | 16.8 | 189 | 0.24 |
| Magnetic material B | 35 | 420 | 0.12 |
| Magnetic material C | 9.3 | 110 | 0.43 |

EXAMPLE 1

| | |
|---|---|
| Styrene/acrylic acid copolymer | 100 parts |
| Magnetic material A (average particle diameter: 0.24 μm; residual magnetization σr in magnetic field of 10,000 oersteds: 16.8 emu/g; coercive force Hc: 189 oersteds) | 50 parts |
| wax A | 5 parts |
| Chromium complex of monoazo dye | 1 part |

The above materials were melt-kneaded using a twin-screw extruder heated to 130° C., followed by cooling. The resulting kneaded product was crushed using a hammer mill, and the crushed product was pulverized using a jet mill. The pulverized product thus obtained was classified using a fixed wall type air classifier and then fine powder and coarse powder were simultaneously strictly classified using a multi-division classifier utilizing the Coanda effect (Elbow Jet Classifier, manufactured by Nittetsu Mining Co., Ltd.). Thus, a black fine powder (magnetic toner 1) with a volume average particle diameter of 12.3 μm was obtained.

Based on 100 parts of the above magnetic toner, 0.5 part of negatively chargeable fine silica powder was added, followed by thorough blending to give magnetic developer (1) according to the present invention.

Results of DSC measurement on this magnetic toner 1 are shown in Table 5, and the DSC curve during temperature rise of the magnetic toner 1 and the DSC curve during temperature lowering thereof are shown in FIG. 1 and FIG. 2, respectively.

Next, using a laser beam printer LBP-8II, manufactured by Canon Inc., the magnetic developer (1) was set in its device unit to carry out image reproduction. As a result, sharp images were obtained. According to those prescribed in JIS C 6251-1980, MICR characters were printed on 1,000 sheets. As a result, the images obtained had a superior fine-line reproduction. On these 1,000 sheet prints, magnetism was imparted to the printed MICR characters and also the magnetism of the characters was read using a commercially available MICR reader-sorter (3890 Type, manufactured by IBM), to examine accuracy (rate of misread) in magnetic-ink character recognition. As a result, the rate of misread was as good as 1.8%. After passing through the MICR reader-sorter, none of smearing and falling-off of the MICR characters nor contamination of the magnetic head of the MICR reader-sorter were seen.

Results obtained are shown in Table 6.

The fine-line reproduction of images was judged in the following way.

Figure 19:
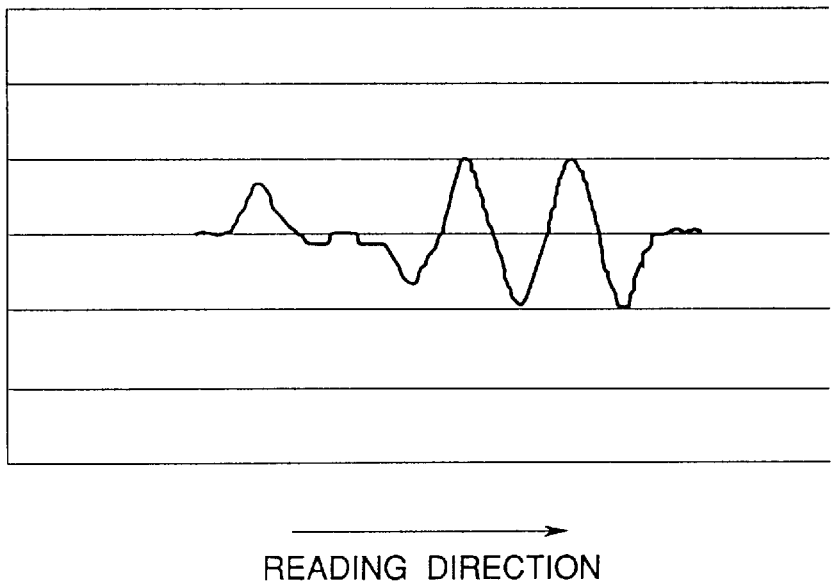
FIG. 19 illustrates a signal waveform of "ON-US" symbols shown in FIG. 18.

MICR characters were printed according to JIS-C6251-1980, and magnetic signal intensity of ON-US symbols as shown in FIG. 18 was measured to obtain a signal waveform as shown in FIG. 19. On the basis of the waveform obtained, the fine-line reproduction was judged.

The image density was measured using a Macbeth reflection densitometer, and judged from average density of 10 sheets of image samples.

The accuracy of magnetic reading was calculated according to the following expression. Accuracy (rate of misread)=

$$\frac{\text{The number of sheets of prints misread}}{\text{1,000 (the number of sheets of prints read)}} \times 100$$

EXAMPLES 2 to 5

Magnetic toners 2 to 5 were prepared in the same manner as in Example 1 except that waxes B to E were respectively used. Magnetic developers (2) to (5) were also prepared in the same way. Results of DSC measurement on these magnetic toners 2 to 5 are shown in Table 5.

Prints were also obtained using the magnetic developers (2) to (5) and passed through the MICR reader-sorter in the same manner as in Example 1. Results obtained are shown in Table 6.

COMPARATIVE EXAMPLES 1 to 3

Comparative magnetic toners 1 to 3 were prepared in the same manner as in Example 1 except that waxes F to I were respectively used. Magnetic developers (6) to (8) were also prepared in the same way. Results of DSC measurement on these comparative magnetic toners 1 to 3 are shown in Table 5.

Prints were also obtained using the magnetic developers (6) to (8) and passed through the MICR reader-sorter in the same manner as in Example 1. Results obtained are shown in Table 6.

COMPARATIVE EXAMPLE 4

Comparative magnetic toner 4 was prepared in the same manner as in Example 1 except that no wax was used. Magnetic developer (9) was also prepared in the same way. Results of DSC measurement on this comparative magnetic toner 4 are shown in Table 5. The endothermic peak thereof is ascribed to the binder resin, which is also seen in other magnetic developers.

Prints were also obtained using the magnetic developer (9) and passed through the MICR reader-sorter in the same manner as in Example 1. Results obtained are shown in Table 6.

COMPARATIVE EXAMPLE 5

Comparative magnetic toner 5 was prepared in the same manner as in Example 1 except that magnetic material A was replaced with magnetic material B. Magnetic developer (10) was also prepared in the same way. Results of DSC measurement on this comparative magnetic toner 5 are shown in Table 5.

Prints were also obtained using the magnetic developer (10) and passed through the MICR reader-sorter in the same manner as in Example 1. Results obtained are shown in Table 6.

COMPARATIVE EXAMPLE 6

Comparative magnetic toner 6 was prepared in the same manner as in Example 1 except that magnetic material A was replaced with magnetic material C. Magnetic developer (11) was also prepared in the same way. Results of DSC measurement on this comparative magnetic toner 6 are shown in Table 5.

Prints were also obtained using the magnetic developer (11) and passed through the MICR reader-sorter in the same manner as in Example 1. Results obtained are shown in Table 6.

COMPARATIVE EXAMPLE Example 7

Comparative magnetic toner 7 was prepared in the same manner as in Example 1 except that magnetic material A was replaced with magnetic material B and also no wax was used. Magnetic developer (12) was also prepared in the same way. Results of DSC measurement of this comparative magnetic toner 7 are shown in Table 5.

Prints were also obtained using the magnetic developer (12) and passed through the MICR reader-sorter in the same manner as in Example 1. Results obtained are shown in Table 6.

TABLE 5

| | | | DSC Characteristics of Toner | | | |
|---|---|---|---|---|---|---|
| | | | At Temperature rise | | At Temperature drop | |
| Toner | Wax | Magnetic material | Onset temp. (° C.) | Endothermic peak temp. (° C.) | Exothermic peak temp. (° C.) | Intensity ratio ($x10^{-3}$) |
| Magnetic toner; | | | | | | |
| 1 | Wax A | Mat. A | 98 | 110 | 68 | 23.4 |
| 2 | Wax B | Mat. A | 99 | 112 | 69 | 29.8 |
| 3 | Wax C | Mat. A | 95 | 106 | 65 | 26.1 |
| 4 | Wax D | Mat. A | 101 | 115 | 69 | 18.4 |
| 5 | Wax E | Mat. A | 104 | 116 | 73 | 13.4 |

TABLE 5-continued

| Toner | Wax | Magnetic material | DSC Characteristics of Toner: At Temperature rise: Onset temp. (° C.) | At Temperature rise: Endothermic peak temp. (° C.) | At Temperature drop: Exothermic peak temp. (° C.) | At Temperature drop: Intensity ratio ($x10^{-3}$) |
|---|---|---|---|---|---|---|
| Comparative magnetic toner; | | | | | | |
| 1 | Wax F | Mat. A | 75 | 98 | 64 | 36.5 |
| 2 | Wax G | Mat. A | 100 | 115 | 70 | 4.0 |
| 3 | Wax H | Mat. A | 108 | 126 | 75 | 8.3 |
| 4 | None | Mat. A | 55 | 68 | — | — |
| 5 | Wax A | Mat. B | 98 | 110 | 68 | 23.4 |
| 6 | Wax A | Mat. C | 98 | 110 | 68 | 23.4 |
| 7 | None | Mat. B | 55 | 68 | — | — |

TABLE 6

| | Magnetic developer | Accuracy (%) | Evaluation through MICR reader-sorter: (1) | (2) | (3) | (4) | Image density: (5) | (6) |
|---|---|---|---|---|---|---|---|---|
| Example: | | | | | | | | |
| 1 | Devel.(1) | 1.5 | A | A | A | A | 1.35 | 1.40 |
| 2 | Devel.(2) | 1.2 | A | A | A | A | 1.30 | 1.35 |
| 3 | Devel.(3) | 2.1 | B | A | A | A | 1.30 | 1.35 |
| 4 | Devel.(4) | 1.9 | A | A | B | A | 1.35 | 1.40 |
| 5 | Devel.(5) | 1.7 | A | A | B | A | 1.40 | 1.40 |
| Comparative Example: | | | | | | | | |
| 1 | Devel.(6) | 8.1 | B | B | C | A | 1.10 | 1.10 |
| 2 | Devel.(7) | 10.5 | C | B | C | A | 1.15 | 1.20 |
| 3 | Devel.(8) | 14.0 | B | C | C | A | 1.20 | 1.20 |
| 4 | Devel.(9) | 40.5 | C | C | C | A | 1.30 | 1.00 |
| 5 | Devel.(10) | 52.0 | A | A | A | C*1 | 1.00 | 0.90 |
| 6 | Devel.(11) | 68.2 | A | A | A | C*2 | 1.20 | 1.30 |
| 7 | Devel.(12) | 84.7 | C | C | C | C*1 | 1.00 | 0.80 |

(1): Smearing of MICR characters A: No smearing of characters B: Smearing of characters is slightly seen, but practically usable C: Smearing of characters is seen and questionable in practical use
(2): Dropout of MICR characters A: No dropout of characters. B: Dropout of characters is slightly seen, but practically usable. C: Dropout of characters is seen and questionable in practical use.
(3): Contamination of magnetic head A: No contamination of the head. B: Contamination of the head is slightly seen, but practically usable. C: Dropout of characters is seen and questionable in practical use.
(4): Fine-line reproduction A: Signal waveform is proper, and ON-US symbols are visually observed to be well printed. B: Signal waveform is substantially proper, and ON-US symbols are visually observed to be substantially well printed. C: Signal waveform is disorder, and ON-US symbols are visually observed to be out of shape(*2), or many black spots are seen around line images with a poor fine-line reproduction(*1).
(5): Initial stage
(6): After 1,000 sheet running

What is claimed is:

1. A method of magnetic-ink character recognition comprising:

printing a magnetic-ink character on a recording medium by the use of a magnetic developer;

imparting magnetism to the printed magnetic-ink character;

reading the magnetism of the magnetic-ink character to which magnetism has been imparted by rubbing against the printed magnetic-ink character with a reading means; and recognizing the magnetic-ink character from the magnetism read from the magnetic-ink character;

said magnetic developer comprising a magnetic toner containing at least a binder resin, a magnetic material and a hydrocarbon wax, wherein said hydrocarbon wax is synthesized by reacting carbon monoxide with hydrogen or by polymerizing ethylene, and has a number average molecular weight (Mn) of 600 to 1,000;

said magnetic toner having such properties that a DSC curve of the toner measured by the use of a different scanning calorimeter is characterized in that, when temperature is increased, an endothermic peak is observed which has an onset temperature of 105° C. or below and a peak temperature in a range from 100° C. to 120° C., and when temperature is decreased an exothermic peak is observed which has a peak temperature in a range of from 62° to 75° C. and a peak intensity ratio of $5\times10^{-3}$ or more, wherein said endothermic peak and said exothermic peak are derived from the hydrocarbon wax; and said magnetic material having such properties that in the magnetic field of 10,000 oersteds, a residual magnetization δr is in the range of from 10 emu/g to 30 emu/g and a coercive force Hc is in the range of from 130 oersteds to 300 oersteds.

2. The method of magnetic-ink character recognition according to claim 1, wherein the onset temperature of the endothermic peak is within the range of from 90° C. to 102° C. and the peak temperature of the endothermic peak is in the range of from 102° C. to 115° C.

3. The method of magnetic-ink character recognition according to claim 2, wherein said magnetic toner contains the magnetic material in an amount of from 50 parts by weight to 110 parts by weight based on 100 parts by weight of the binder resin.

4. The method of magnetic-ink character recognition according to claim 1, wherein the peak temperature of the exothermic peak is in the range of from 65° C. to 72° C. and the peak intensity ratio of the exothermic peak is $10\times10^{-3}$ or more.

5. The method of magnetic-ink character recognition according to claim 4, wherein said magnetic developer contains a fine silica powder in an amount of from 0.2 part by weight to 1.6 parts by weight based on 100 parts by weight of the magnetic toner.

6. The method of magnetic-ink character recognition according to claim 4, wherein said magnetic developer contains a fine silica powder in an amount of from 0.4 part by weight to 1.4 parts by weight based on 100 parts by weight of the magnetic toner.

7. The method of magnetic-ink character recognition according to claim 1, wherein the peak intensity ratio of the exothermic peak is $15\times10^{-3}$ or more.

8. The method of magnetic-ink character recognition according to claim 1, wherein said hydrocarbon wax is obtained by extraction fractionation from a hydrocarbon synthesized by reacting carbon monoxide with hydrogen in the presence of a metal oxide catalyst.

9. The method of magnetic-ink character recognition according to claim 8, wherein said hydrocarbon wax is obtained by extraction fractionation from a hydrocarbon formed by polymerization of an alkylene in the presence of a Ziegler catalyst.

10. The method of magnetic-ink character recognition according to claim 1, wherein said hydrocarbon wax has a weight average molecular weight (Mw) of from 800 to 3,600 and a value of Mw/Mn of not more than 3.

11. The method of magnetic-ink character recognition according to claim 1, wherein said hydrocarbon wax has a weight average molecular weight (Mw) of from 900 to 3,000 and a value of Mw/Mn of not more than 2.5.

12. The method of magnetic-ink character recognition according to claim 1, wherein said hydrocarbon wax has a density of 0.95 ($g/cm^3$) or more at 25° C.

13. The method of magnetic-ink character recognition according to claim 1, wherein said hydrocarbon wax has a penetration of 1.5 ($10^{-1}$ mm) or less.

14. The method of magnetic-ink character recognition according to claim 1, wherein said hydrocarbon wax has a softening point (Mp) of 130° C. or below.

15. The method of magnetic-ink character recognition according to claim 1, wherein said magnetic toner contains the hydrocarbon wax in an amount of not more than 20 parts by weight based on 100 parts by weight of the binder resin.

16. The method of magnetic-ink character recognition according to claim 1, wherein said magnetic toner contains the hydrocarbon wax in an amount of from 0.5 part by weight to 10 parts by weight based on 100 parts by weight of the binder resin.

17. The method of magnetic-ink character recognition according to claim 1, wherein said magnetic material has a residual magnetization or in the range of from 14 emu/g to 28 emu/g and a coercive force Hc in the range of from 140 oersteds to 280 oersteds in a magnetic field of 10,000 oersteds.

18. The method of magnetic-ink character recognition according to claim 1, wherein said magnetic toner contains the magnetic material in an amount of from 40 parts by weight to 120 parts by weight based on 100 parts by weight of the binder resin.

19. The method of magnetic-ink character recognition according to claim 1, wherein said magnetic material has an average particle diameter of from 0.1 $\mu$m to 0.6 $\mu$m.

20. The method of magnetic-ink character recognition according to claim 1, wherein said hydrocarbon wax satisfies the properties that, a DSC curve measured using a differential scanning calorimeter is characterized in that, when temperature is increased, an endothermic peak is observed which has an onset temperature in a range from 50° C. to 90° C., and when temperature is decreased a maximum exothermic peak is observed which has a peak temperature in a range of ±9° C. of the peak temperature of the endothermic peak P1.

21. The method of magnetic-ink character recognition according to claim 20, wherein the DSC curve of the hydrocarbon wax has the onset temperature of the endothermic peak within the range of from 55° C. to 90° C. and at least one endothermic peak is present in a temperature range of from 95° C. to 120° C.

22. The method of magnetic-ink character recognition according to claim 20, wherein the DSC curve of the hydrocarbon wax has at least one endothermic peak in a temperature range of from 97° C. to 115° C.

23. The method of magnetic-ink character recognition according to claim 20, wherein the DSC curve of the hydrocarbon wax has the maximum exothermic peak in the range of ±7° C. of the peak temperature of the endothermic peak P1.

24. The method of magnetic-ink character recognition according to claim 20, wherein the DSC curve of the hydrocarbon wax has the maximum exothermic peak in the range of ±5° C. of the peak temperature of the endothermic peak P1.

25. The method of magnetic-ink character recognition according to claim 1, wherein said hydrocarbon wax comprises saturated straight chain hydrocarbons.

26. The method of magnetic-ink character recognition according to claim 1, wherein said hydrocarbon wax satisfies the properties that, a DSC curve measured using a differential scanning calorimeter is characterized in that, when temperature is increased, an endothermic peak is observed which has an onset temperature in a range from 50° C. to 90° C., and at least one endothermic peak P1 is present in a temperature range from 90° C. to 120° C., and when temperature is decreased a maximum exothermic peak is observed which has a peak temperature in a range of ±9° C. of a peak temperature of the endothermic peak P1.

27. The method of magnetic-ink character recognition according to claim 26, wherein the DSC curve of the hydrocarbon wax has an onset temperature of the endothermic peak within the range from 55° C. to 90° C., and at least one endothermic peak is present in a temperature range from 90° C. to 120° C.

28. The method of magnetic-ink character recognition according to claim 26, wherein the DSC curve of the hydrocarbon wax has at least one endothermic peak in a temperature range from 97° C. to 115° C.

29. The method of magnetic-ink character recognition according to claim 26, wherein the DSC curve of the hydrocarbon wax has the maximum exothermic peak in the range of ±7° C. of the peak temperature of the endothermic peak P1.

30. The method of magnetic-ink character recognition according to claim 26, wherein the DSC curve of the hydrocarbon wax has the maximum exothermic peak in the range of ±5° C. of the peak temperature of the endothermic peak P1.

* * * * *